US008104857B2

(12) United States Patent
Takahashi et al.

(10) Patent No.: US 8,104,857 B2
(45) Date of Patent: Jan. 31, 2012

(54) METHOD OF CALCULATING CORRECTION VALUE, CORRECTION VALUE CALCULATING PROGRAM, AND LIQUID EJECTING APPARATUS

(75) Inventors: Toru Takahashi, Matsumoto (JP); Toru Miyamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 454 days.

(21) Appl. No.: 12/384,973

(22) Filed: Apr. 9, 2009

(65) Prior Publication Data

US 2009/0256877 A1 Oct. 15, 2009

(30) Foreign Application Priority Data

Apr. 10, 2008 (JP) ..... 2008-102711

(51) Int. Cl.
*B41J 29/38* (2006.01)

(52) U.S. Cl. ..... 347/14; 347/15; 347/19; 358/1.2

(58) Field of Classification Search ..... 347/14, 347/15, 19; 358/1.2
See application file for complete search history.

(56) References Cited

FOREIGN PATENT DOCUMENTS

JP 2006-305952 11/2006

*Primary Examiner* — Laura Martin
(74) *Attorney, Agent, or Firm* — Nutter McClennen & Fish LLP; John J. Penny, Jr.; Christopher J. Stow

(57) ABSTRACT

A method of calculating a correction value includes forming a test pattern in which a dot row formed A method of calculating a correction value includes forming a test pattern in which a dot row formed by aligning dots in a direction intersecting a predetermined direction is aligned in the predetermined direction on a medium and forming information on the test pattern on the medium, calculating a correction value of the first nozzle group based on the pattern included in read-out data values in a case where the information included in the read-out data values represents that the test pattern is formed by a first nozzle group, and calculating a correction value of a second nozzle group based on the test pattern included in the read-out data values in a case where the information included in the read-out data values represents that the test pattern is formed by the second nozzle group.

6 Claims, 21 Drawing Sheets

FIG. 12

| ROW AREA NUMBER | CYAN | | | | |
|---|---|---|---|---|---|
| | Sa | Sb | Sc | Sd | Se |
| 1 | Ha_1 | Hb_1 | Hc_1 | Hd_1 | He_1 |
| 2 | Ha_2 | Hb_2 | Hc_2 | Hd_2 | He_2 |
| 3 | Ha_3 | Hb_3 | Hc_3 | Hd_3 | He_3 |
| ⋮ | | | ⋮ | | |
| N−1 | Ha_N−1 | Hb_N−1 | Hc_N−1 | Hd_N−1 | He_N−1 |
| 180 × n = N | Ha_N | Hb_N | Hc_N | Hd_N | He_N |

METHOD OF CALCULATING CORRECTION VALUE, CORRECTION VALUE CALCULATING PROGRAM, AND LIQUID EJECTING APPARATUS

The present application claims the priority based on a Japanese Patent Application No. 2008-102711 filed on Apr. 10, 2008, the disclosure of which is hereby incorporated by reference in its entirety.

BACKGROUND

1. Technical Field

The present invention relates to a method of calculating a correction value, a correction value calculating program, and a liquid ejecting apparatus.

2. Related Art

As one type of liquid ejecting apparatus, there are ink jet printers that perform a printing operation by ejecting ink on various media such as a sheet, a cloth, or a film from a nozzle. In the above-described ink jet printer, landing of ink droplets in an inappropriate position on the medium or a difference of ink ejecting amounts may occur due to a problem such as accuracy of nozzle processing, and whereby non-uniformity of density occurs.

Thus, a correction value is calculated such that an image piece that is visually recognized thin is printed thick and an image piece that is visually recognized thick is printed thin. Accordingly, an actual test pattern is printed by the printer. Then, a method in which the test pattern is read out by the scanner, and a correction value is calculated based on the read-out result has been proposed (for example, JP-A-2006-305952).

In a case where test patterns are printed on a plurality of sheets, when the order of sheets to be read out by the scanner is incorrectly set or a sheet is set in a scanner by reversing the vertical direction of the sheet, an incorrect correction value is calculated.

SUMMARY

An advantage of some aspects of the invention is that it provides a method of calculating a correction value, a correction value calculating program, and a liquid ejecting apparatus capable of calculating a correction value accurately.

According to a major aspect of the invention, there is provided a method of calculating a correction value. The method includes: forming a test pattern in which a dot row formed by aligning dots in a direction intersecting a predetermined direction is aligned in the predetermined direction on a medium and forming information on the test pattern on the medium, by using a first nozzle group of a liquid ejecting apparatus that includes a nozzle row, in which a plurality of nozzles ejecting liquid is aligned in the predetermined direction, having the first nozzle group and a second nozzle group; forming a test pattern in which a dot row formed by aligning dots in the intersecting direction is aligned in the predetermined direction on a medium and forming information on the test pattern on the medium, by using the second nozzle group of the liquid ejecting apparatus; acquiring two read-out data values by individually reading out the two media by using a scanner; and identifying the information included in the read-out data values, calculating a correction value of the first nozzle group based on the test pattern included in the read-out data values in a case where the information included in the read-out data values represents that the test pattern is formed by the first nozzle group, and calculating a correction value of the second nozzle group based on the test pattern included in the read-out data values in a case where the information included in the read-out data values represents that the test pattern is formed by the second nozzle group.

Other aspects of an embodiment of the invention will be apparent by descriptions here and accompanying drawings.

BRIEF DESCRIPTION OF THE DRAWINGS

The invention will be described with reference to the accompanying drawings, wherein like numbers reference like elements.

FIG. 12 is a correction value table.

DESCRIPTION OF EXEMPLARY EMBODIMENTS

Figure 1:
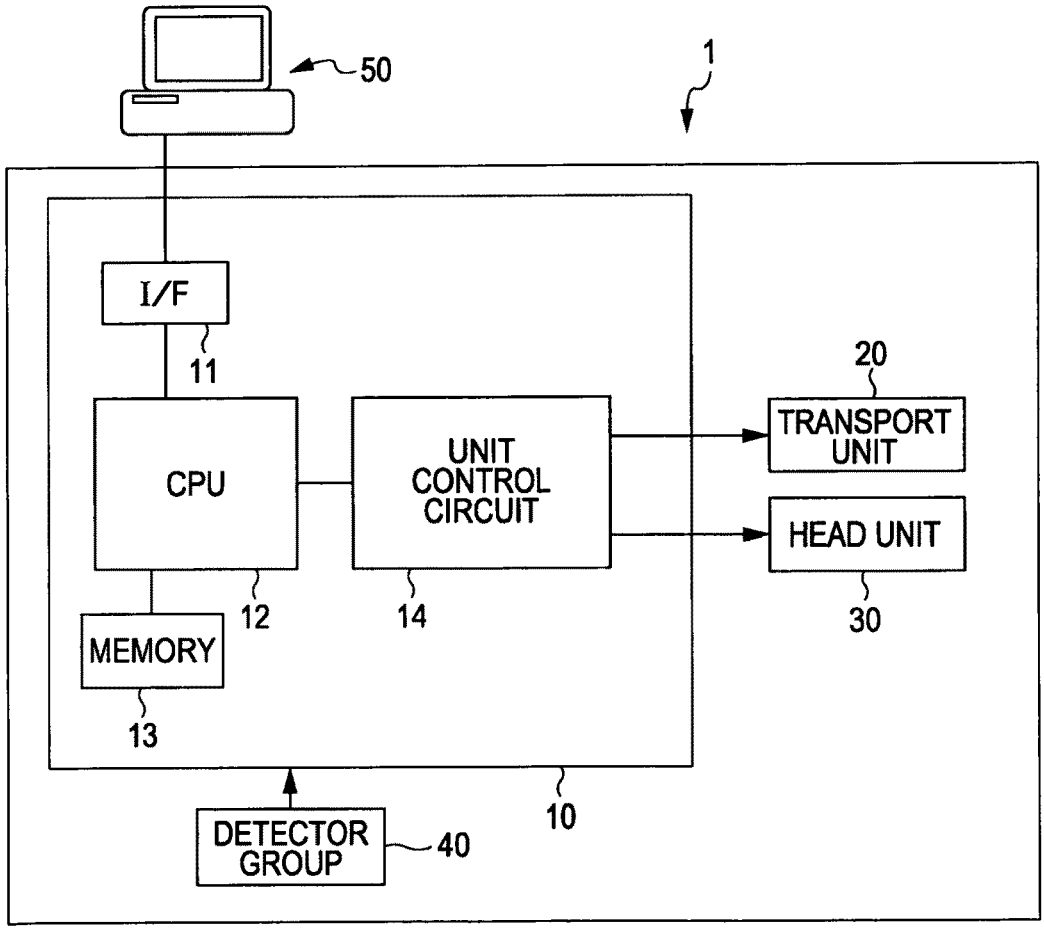
FIG. 1 is a block diagram showing the whole configuration of a printer according to an embodiment of the invention.

By descriptions here and description of the attached drawings, at least the followings become apparent.

According to a first aspect of the invention, there is provided a method of calculating a correction value. The method includes: forming a test pattern in which a dot row formed by aligning dots in a direction intersecting a predetermined direction is aligned in the predetermined direction on a medium and forming information on the test pattern on the medium, by using a first nozzle group of a liquid ejecting apparatus that includes a first nozzle group in which a plurality of nozzles ejecting liquid is aligned in the predetermined direction and a second nozzle group in which a plurality of nozzles ejecting liquid is aligned in the predetermined direction; forming a test pattern in which a dot row formed by aligning dots in the intersecting direction is aligned in the predetermined direction on a medium and forming information on the test pattern on the medium, by using the second nozzle group of the liquid ejecting apparatus; acquiring two read-out data values by individually reading out the two media by using a scanner; and identifying the information included in the read-out data values, calculating a correction value of the first nozzle group based on the test pattern included in the read-out data values in a case where the information included in the read-out data values represents that the test pattern is formed by the first nozzle group, and calculating a correction value of the second nozzle group based on the test pattern included in the read-out data values in a case where the information included in the read-out data values represents that the test pattern is formed by the second nozzle group.

According to the above-described method of calculating the correction value, an accurate correction value can be calculated.

According to a second aspect of the invention, there is provided a method of calculating a correction value. The method includes: forming a test pattern in which a dot row formed by aligning dots in a direction intersecting a predetermined direction is aligned in the predetermined direction on a medium and forming information on the test pattern on the medium, by using a first nozzle group of a liquid ejecting apparatus that includes a nozzle row, in which a plurality of nozzles ejecting liquid is aligned in the predetermined direction, having the first nozzle group and a second nozzle group; forming a test pattern in which a dot row formed by aligning dots in the intersecting direction is aligned in the predetermined direction on a medium and forming information on the test pattern, on the medium, by using the second nozzle group of the liquid ejecting apparatus; acquiring two read-out data values by individually reading out the two media by using a scanner; and identifying the information included in the read-out data values, calculating a correction value of the first nozzle group based on the test pattern included in the read-out data values in a case where the information included in the read-out data values represents that the test pattern is formed by the first nozzle group, and calculating a correction value of the second nozzle group based on the test pattern included in the read-out data values in a case where the information included in the read-out data values represents that the test pattern is formed by the second nozzle group.

According to the above-described method of calculating the correction value, an accurate correction value can be calculated.

In the above-described method of calculating the correction value, it may be configured that the information is formed on one side of the test pattern on the medium in the predetermined direction or the intersecting direction in the forming of the test pattern and the information, and the direction of the test pattern is determined based on positional relationship of the information included in the read-out data values and the test pattern in the identifying of the information and calculating of the correction value.

In such a case, even when the direction in which the medium is set in the scanner is not fixed, the direction of the test pattern can be determined, and accordingly, an accurate correction value can be calculated.

In addition, in the above-described method of calculating the correction value, it may be configured that the liquid ejecting apparatus includes a plurality of the nozzle rows, and the plurality of the nozzle rows ejects different types of liquid, and the read-out data values are identified based on the type of the liquid represented by the information included in the read-out data values, and the correction value is calculated for each type of the liquid, in the identifying of the information and calculating of the correction value.

In such a case, it can be prevented that a correction value is calculated based on the read-out data value of a test pattern formed by a nozzle row that ejects different liquid. Accordingly, an accurate correction value can be calculated.

In addition, in the above-described method of calculating a correction value, a case where there is the test pattern that is formed on the medium based on the information included in the read-out data by the liquid ejecting apparatus and is not read out by the scanner may be configured to be notified in the identifying of the information and calculating of the correction value.

In such a case, correction values for all the nozzles can be calculated.

According to a third aspect of the invention, there is provided a program for calculating a correction value. The program allows a computer to perform: a function for forming a test pattern in which a dot row formed by aligning dots in a direction intersecting a predetermined direction is aligned in the predetermined direction on a medium and forming information on the test pattern on the medium, by using a first nozzle group of a liquid ejecting apparatus that includes a nozzle row, in which a plurality of nozzles ejecting liquid is aligned in the predetermined direction, having the first nozzle group and a second nozzle group; a function for forming a test pattern in which a dot row formed by aligning dots in the intersecting direction is aligned in the predetermined direction on a medium and forming information on the test pattern on the medium, by using the second nozzle group of the liquid ejecting apparatus; a function for acquiring two read-out data values by individually reading the two media by using a scanner; and a function for identifying the information included in the read-out data values, calculating a correction value of the first nozzle group based on the test pattern included in the read-out data values in a case where the information included in the read-out data values represents that the test pattern is formed by the first nozzle group, and calculating a correction value of the second nozzle group based on the test pattern included in the read-out data values in a case where the information included in the read-out data values represents that the test pattern is formed by the second nozzle group.

According to the above-described program for calculating the correction value, an accurate correction value can be calculated.

Line Head Printer

Hereinafter, an ink jet printer as a liquid ejecting apparatus according to an embodiment of the invention, and more particularly, a line head printer (printer 1) as one type of the ink jet printer will be described as an example.

Figure 2A:
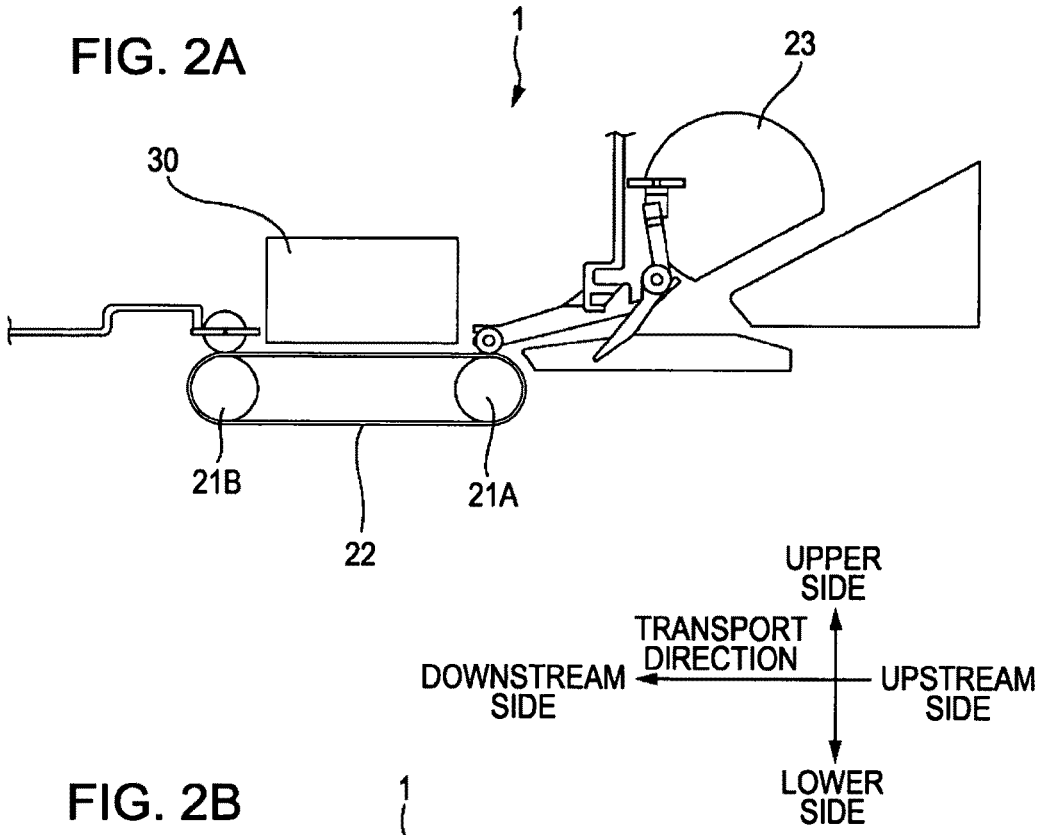
FIG. 2A is a cross-section view of the printer.
Figure 2B:
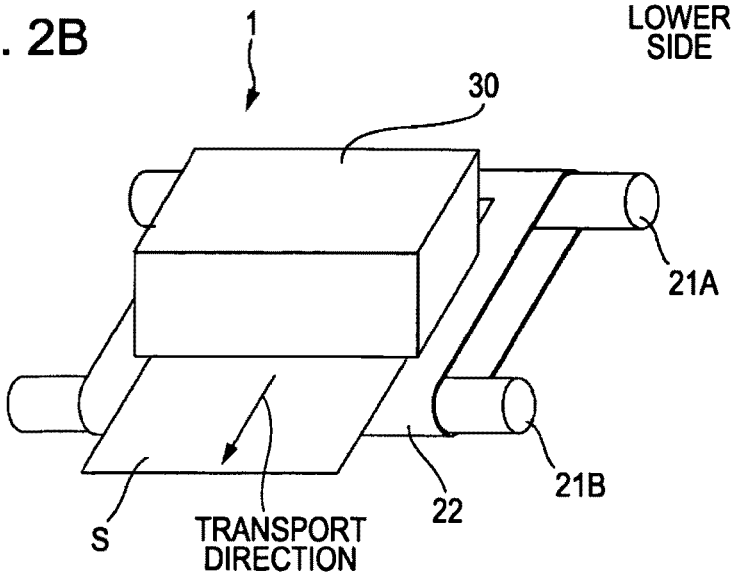
FIG. 2B is a diagram showing an appearance of transporting a medium.

FIG. 1 is a block diagram showing the whole configuration of a printer 1 according to this embodiment. FIG. 2A is a cross-section view of the printer 1. FIG. 2B is a diagram showing the appearance of transporting a sheet S (medium) in the printer 1. The printer 1 that receives print data from a computer 50 as an external apparatus forms an image on a sheet S by controlling units (a transport unit 20 and a head unit 30) by using a controller 10. In addition, a detector group 40 monitors the internal state of the printer 1, and the controller 10 controls the units based on the result of detection.

The controller 10 is a control unit that is used for performing a control operation for the printer 1. An interface unit 11 is used for transmitting and receiving data between the computer 50 as an external apparatus and the printer 1. A CPU 12 is an arithmetic processing device that is used for controlling the entire printer 1. A memory 13 is used for securing an area for storing a program of the CPU 12, a work area, and the like. The CPU 12 controls each unit based on the program that is stored in the memory 13 by using the unit control circuit 14.

A transport unit 20 includes transport rollers 21A and 21B and a transport belt 22. The transport unit 20 transports a sheet S to a printable position and transports the sheet S in the transport direction (corresponding to an intersecting direction) at a predetermined transport speed in a printing process. A feed roller 23 is a roller that is used for automatically feeding the sheet S that is inserted into a paper inserting port on the transport belt 22 inside the printer 1. The transport belt 22 having a ring shape is rotated by the transport rollers 21A and 21B, and whereby the sheet S on the transport belt 22 is transported. In addition, electrostatic adsorption or vacuum adsorption is performed for the sheet on the transport belt 22 from the lower side.

The head unit 30 is used for ejecting ink on a sheet and includes a plurality of heads 31. On a lower face of the head 31, a plurality of nozzles as ink ejecting units is disposed. In each nozzle, a pressure chamber (not shown) in which ink is inserted and a driving element (piezo element) that is used for ejecting ink by changing the volume of the pressure chamber are disposed.

Figure 3:
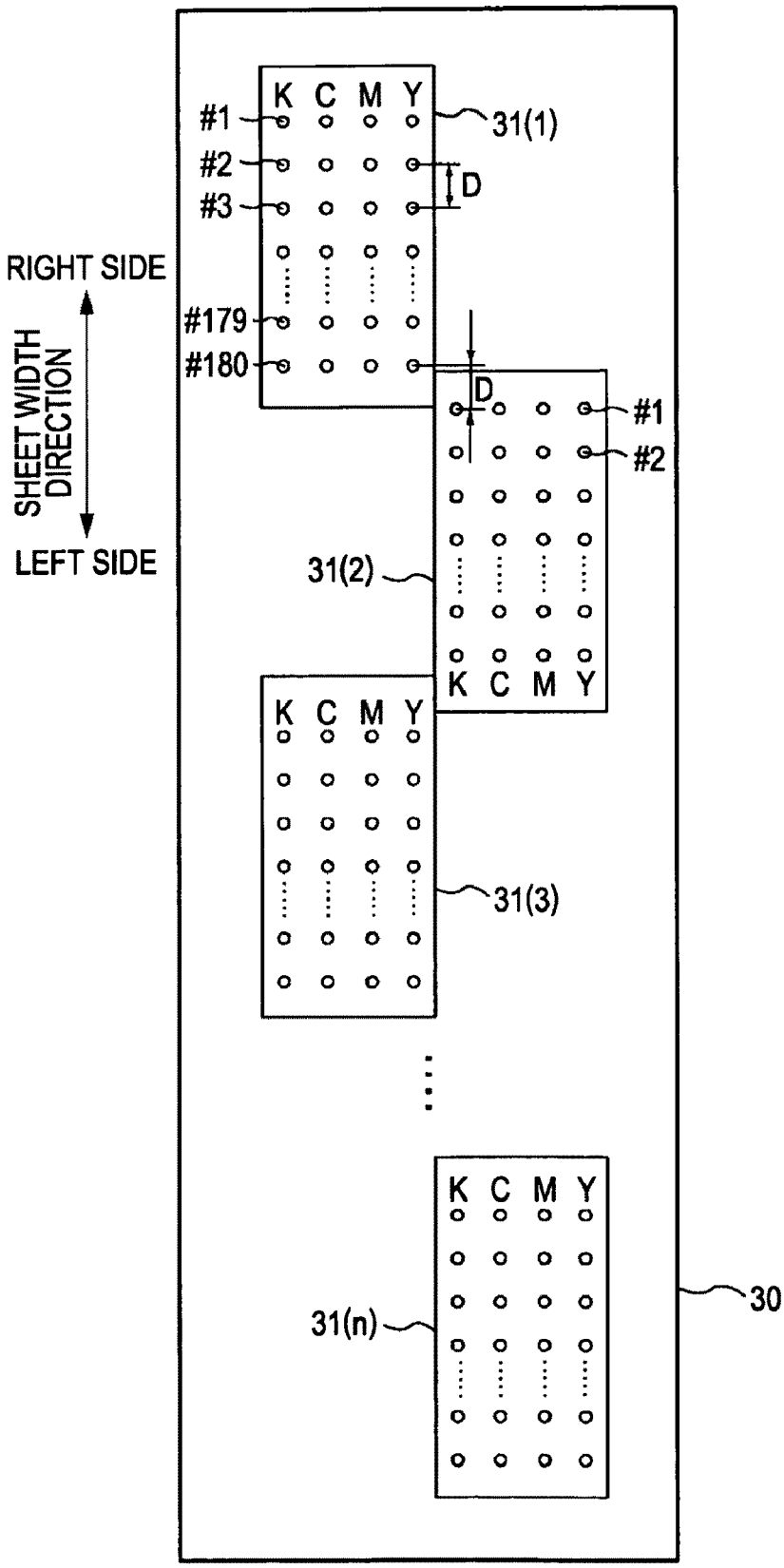
FIG. 3 is a diagram showing a nozzle arrangement on a lower face of a head unit.

FIG. 3 shows a nozzle arrangement on the lower face of the head unit 30. The head unit 30 includes a plurality of (n) heads 31. From a head 31 located on the right side in the sheet width direction (corresponds to a predetermined direction), a first head 31 (1), a second head 31 (2), . . . , an n-th head 31(*n*) are sequentially disposed. The plurality of the heads 31 is disposed so as to be aligned in a zigzag pattern in the sheet width direction that intersects the transport direction. On the lower face of the head 31, a yellow ink nozzle row Y, a magenta ink nozzle row M, a cyan ink nozzle row C, and a black ink nozzle row K are formed, and each nozzle row has 180 nozzles. The nozzles of each nozzle row are aligned in the sheet width direction with a predetermined distance D interposed therebetween.

In addition, the heads 31 are disposed such that a distance between the rightmost nozzle (for example, #1 of 31(2)) of the left head between two heads 31 aligned in the sheet width direction and the leftmost nozzle (for example, #180 of 31(1)) of the right head is a predetermined distance D. In other words, within the head unit 30, nozzles (YMCK) of four colors are aligned in the sheet width direction with a predetermined distance D interposed therebetween.

In such a line head printer, when the controller 10 receives print data, the controller 10, first, rotates the feed roller 23 so as to transmit a sheet S to be printed on the transport belt 22. The sheet S is transported on the transport belt 22 at a constant speed without stopping and passes below the head unit 30. While the sheet S passes below the head unit 30, ink is intermittently ejected from each nozzle. As a result, a dot row formed of a plurality of dots in the transport direction is formed on the sheet S, and whereby an image is printed.

Non-Uniformity of Density

For description below, a "pixel area" and a "row area" are defined here. The pixel area represents a rectangular area that is virtually determined on a sheet. The size and the shape of the pixel area are determined in accordance with the printing resolution. One "pixel" that configures image data corresponds to one pixel area. In addition, a "row area" is an area located on the sheet which is configured by a plurality of the pixel areas aligned in the transport direction. A "pixel row" of data in which pixels are aligned in a direction corresponding to the transport direction corresponds to one row area.

Figure 4A:
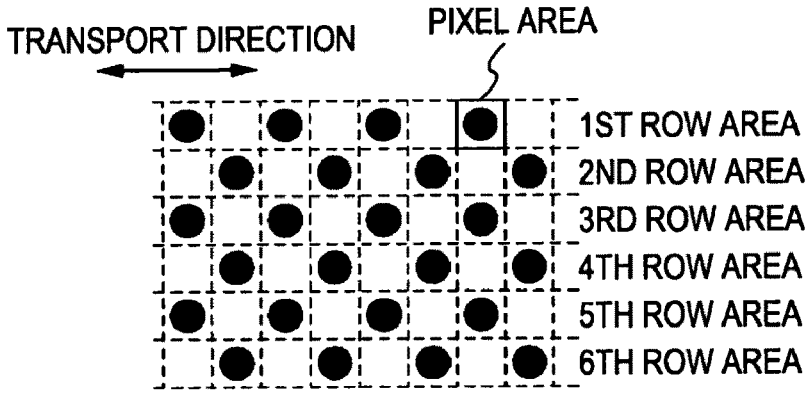
FIG. 4A is a diagram showing ideal dot formation.

FIG. 4A is an explanatory diagram showing appearance of a case where dots are formed ideally. To form a dot ideally means that an ink droplet lands in a center position of a pixel area, the ink droplet spreads on the sheet, and a dot is formed in a pixel area. When each dot is accurately formed in each pixel area, a raster line (a dot row in which dots are aligned in the transport direction) is formed accurately in a row area.

Figure 4B:
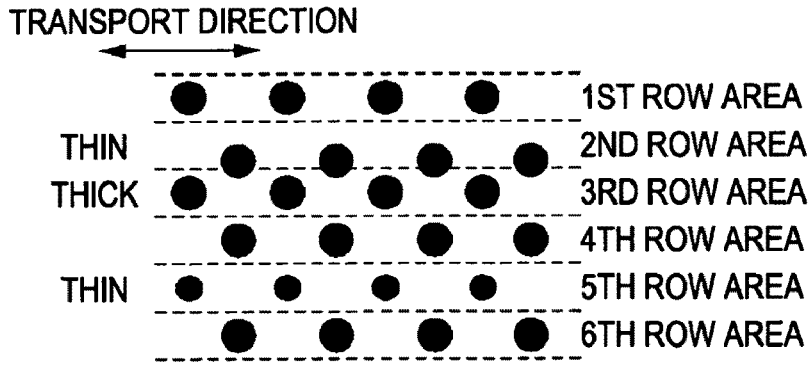
FIG. 4B is a diagram showing non-uniformity of density.

FIG. 4B is an explanatory diagram of a case where non-uniformity of density occurs. A raster line that is formed in the second row area is formed to be brought near the third row area due to variation of the flying direction of ink droplets ejected from the nozzle. As a result, the second row area becomes thin, and the third row area becomes thick. In addition, the ink amount of ink droplets ejected to the fifth row area is smaller than a regulated ink amount, and accordingly, dots formed in the fifth row area are small. As a result, the fifth row area becomes thin. When a printed image that is formed of raster lines having different density is viewed macroscopically, non-uniformity of density having a striped shape in the transport direction is visually recognized. This non-uniformity of density becomes a reason for degrading the image quality of the printed image.

Figure 4C:
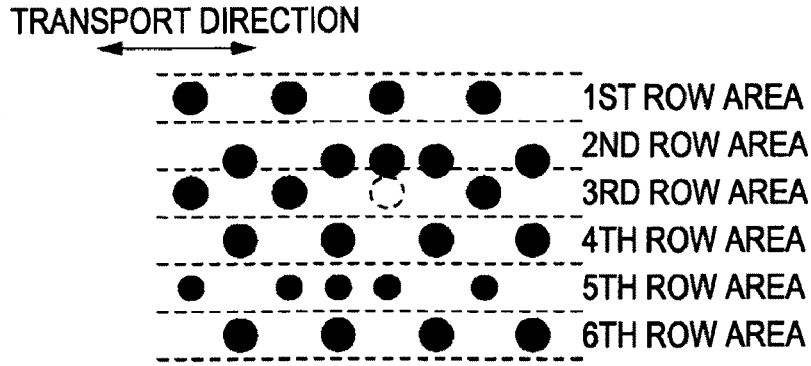
FIG. 4C is a diagram showing dot formation according to an embodiment of the invention.

FIG. 4C is an explanatory diagram showing appearance of a case where dots are formed by using a printing method according to this embodiment. According to this embodiment, for a row area that can be easily recognized to be thick, the gray scale values of pixel data of pixels corresponding to the row area are corrected so as to form a thin image piece. On the other hand, for a row area that can be easily recognized to be thin, the gray scale values of the pixel data of pixels corresponding to the row area are corrected so as to form a thick image piece.

For example, in FIG. 4C, gray scale values of pixel data of pixels corresponding to each row area are corrected such that dot generation ratios of the second and the fifth row areas recognized to be thin is increased and the dot generation ratio of the third row area recognized to be thick is decreased. Accordingly, the dot generation ratio for the raster line of each row area is changed, and thereby the density of an image piece of a row area is corrected. Therefore, the density non-uniformity of the entire printed image is suppressed.

In FIG. 4B, the reason that the density of an image piece that is formed in the third row area becomes thick is not by the influence of a nozzle that forms the raster line in the third row area but by the influence of a nozzle that forms a raster line in the adjacent second row area. Accordingly, when the nozzle that forms the raster line in the third row area forms a raster line in a different row area, it cannot be determined that an image piece formed in the row area becomes thick. In other words, even for image pieces that are formed by a same nozzle, when a nozzle that forms an adjacent image piece is different, the density may be different. In such a case, the non-uniformity of density cannot be suppressed by using correction values corresponding to the nozzles only. Accordingly, in this embodiment, a gray scale value of the pixel data is corrected based on a correction value set for each row area.

Method of Calculating Correction Value H: First Embodiment

Figure 5:
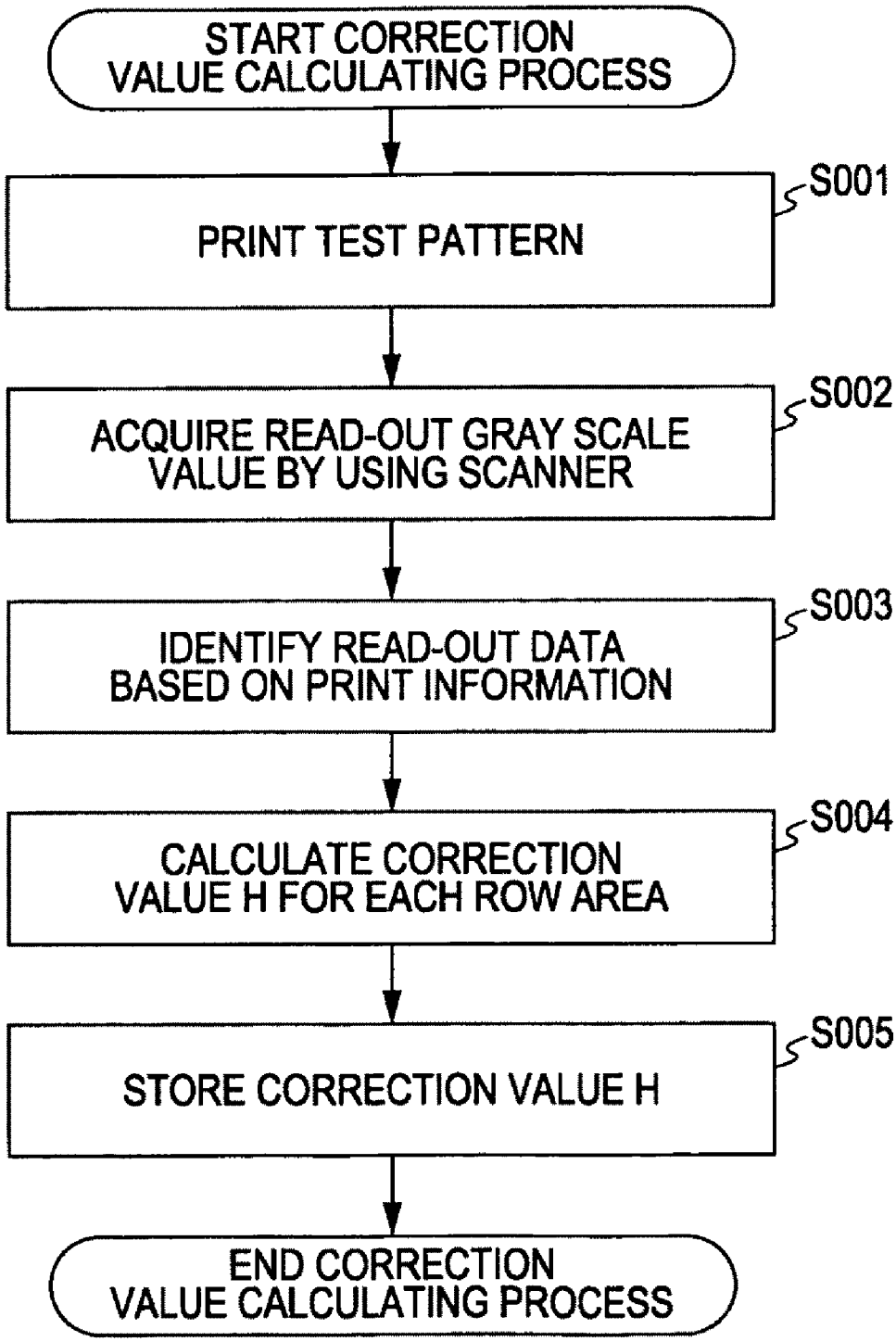
FIG. 5 is a flowchart of a method of calculating a correction value.

FIG. 5 is a flowchart of calculating a correction value H that is performed in a test process after manufacture of a printer. For the test, the printer 1 to be tested for non-uniformity of density and a scanner are connected to a computer 50. According to this embodiment, in order to calculate the correction value H for each row area, first, a test pattern is actually printed by the printer 1 (S001). Then, the test pattern is read out by the scanner (S002). In addition, according to this embodiment, on a sheet on which the test pattern is printed, print information (to be described in detail later) of the test pattern is printed together. Thus, a correction value acquiring program that is used for calculating the correction value H identifies the print information (corresponding to information included in the read-out data) that is included in the read-out data read out by the scanner. In addition, the correction value acquiring program, for example, checks in which color of a nozzle row the test pattern included in the read-out data is formed (S003). For a row area in which a printing operation is performed to be thicker than a target density (gray scale value) in the read-out result of the test pattern (corresponding to a test pattern of the read-out data), a correction value H for having the row area to be printed thinner is calculated. On the contrary, for a row area in which a printing operation is performed to be thinner than the target density (gray scale value), a correction value H for having the row area to be printed thicker is calculated (S004). In addition, in the computer 50, a printer driver, a scanner driver, and a correction value acquiring program are installed in advance. Accordingly, the computer 50 prints a test pattern in accordance with the printer driver, the test pattern is read out in accordance with the scanner driver, and the correction value H is calculated in accordance with the correction value acquiring program (here, the printer driver, the scanner driver, and the correction value acquiring program are collectively referred to as the correction value calculating program).

Figure 6A:
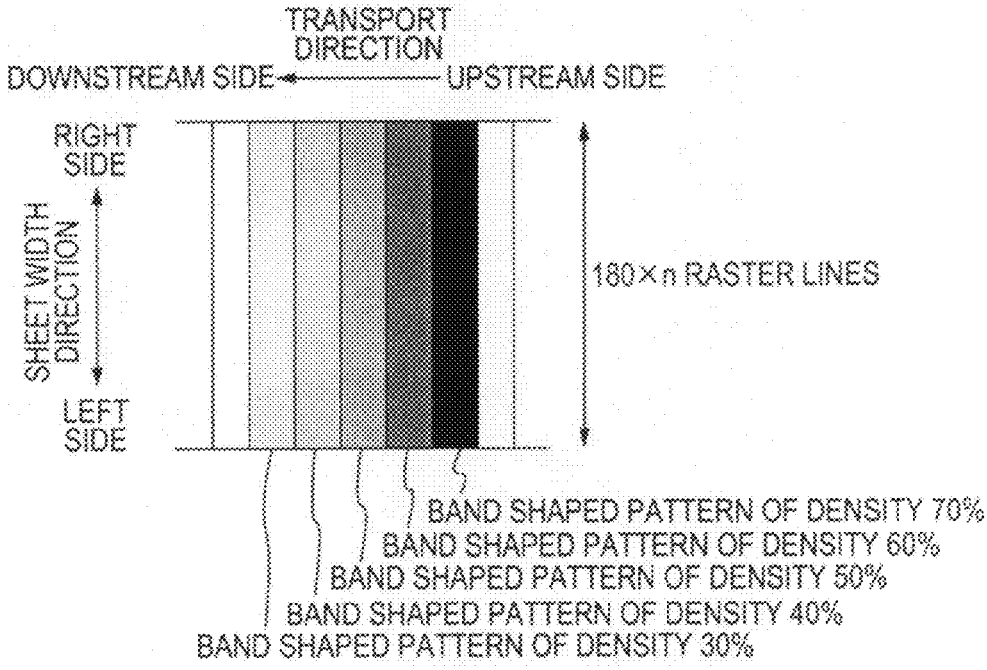
FIG. 6A is a diagram showing an overview of a test pattern.

FIG. 6A is a diagram showing the overview of the test pattern that is printed by the printer 1. The test pattern is configured by band-shaped patterns of five types of density. The band-shaped patterns are generated based on image data of predetermined gray scale values. The gray scale value of the band-shaped pattern is referred to as a directed gray scale value. In addition, a directed gray scale value of a band-shaped pattern of density 30% is denoted by Sa(76), a directed gray scale value of a band-shaped pattern of density 40% is denoted by Sb(102), a directed gray scale value of a band-shaped pattern of density 50% is denoted by Sc(128), a directed gray scale value of a band-shaped pattern of density 60% is denoted by Sd(153), and a directed gray scale value of a band-shaped pattern of density 70% is denoted by Se(178). The above-described test patterns are printed for each nozzle row (YMCK) of the printer 1.

Figure 6B:
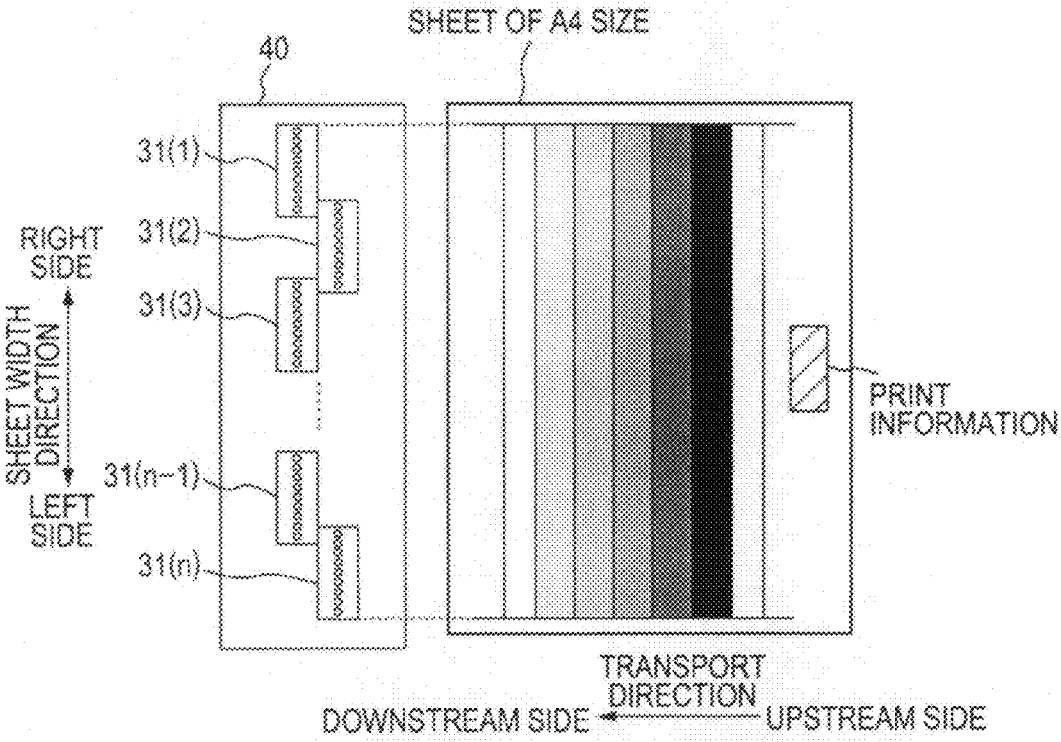
FIG. 6B is a diagram showing positional relationship between a head and a test pattern.

FIG. 6B is a diagram showing positional relationship between the head 31 of the printer 1 according to the first embodiment and the test pattern. The line head printer according to the first embodiment is a small-sized printer and is referred to as an "A4-size sheet" printer. Accordingly, the printer 1 according to the first embodiment prints the test pattern on a sheet of A4 size. In the line printer, an image is printed on a sheet by transporting the sheet below the head unit 30 without moving the head unit 30. In addition, in a printer like the printer 1 according to this embodiment that does not have a plurality of the head units 30 (FIG. 3), one nozzle corresponds to one row area (one pixel row). In such a case, a maximum image that can be printed by the printer 1 is configured by raster lines (dot rows aligned in the transport direction) corresponding to the number of nozzles (180×n) that are included in the printer 1. In other words, raster lines are formed by each nozzle for 180×n row areas on the sheet. Accordingly, the number of the correction values H to be calculated is 180×n, and the test pattern is configured by 180×n raster lines. In addition, a right nozzle in the sheet width direction, that is, a row area corresponding to nozzle #1 of the first head 31(1) is set as the first row area. In addition, according to this embodiment, as shown in FIG. 6B, on a sheet on which the test pattern is printed, the print information of the test pattern is printed together.

However, even when the scanner reads out a same image under a same use condition and the like (a problem of occurrence of noise and the like), there may be a small read-out error between read-out results for a case where the image is not simultaneously read out by the scanner. In addition, when a same image is printed by the printer 1 based on the same print data, there may be small error of the density of a printed image. Thus, a same test pattern is printed by the printer 1 several times, and a plurality of the printed test patterns are individually read out by the scanner. Then, by calculating the correction value H based on the average value of the read-out results of the plurality of the test patterns, a high-accuracy correction value H in which the read-out error of the scanner and the printing error are reduced can be calculated.

<Printing of Test Pattern and Reading-Out of Test Pattern according to Comparative Example>

Figure 7:
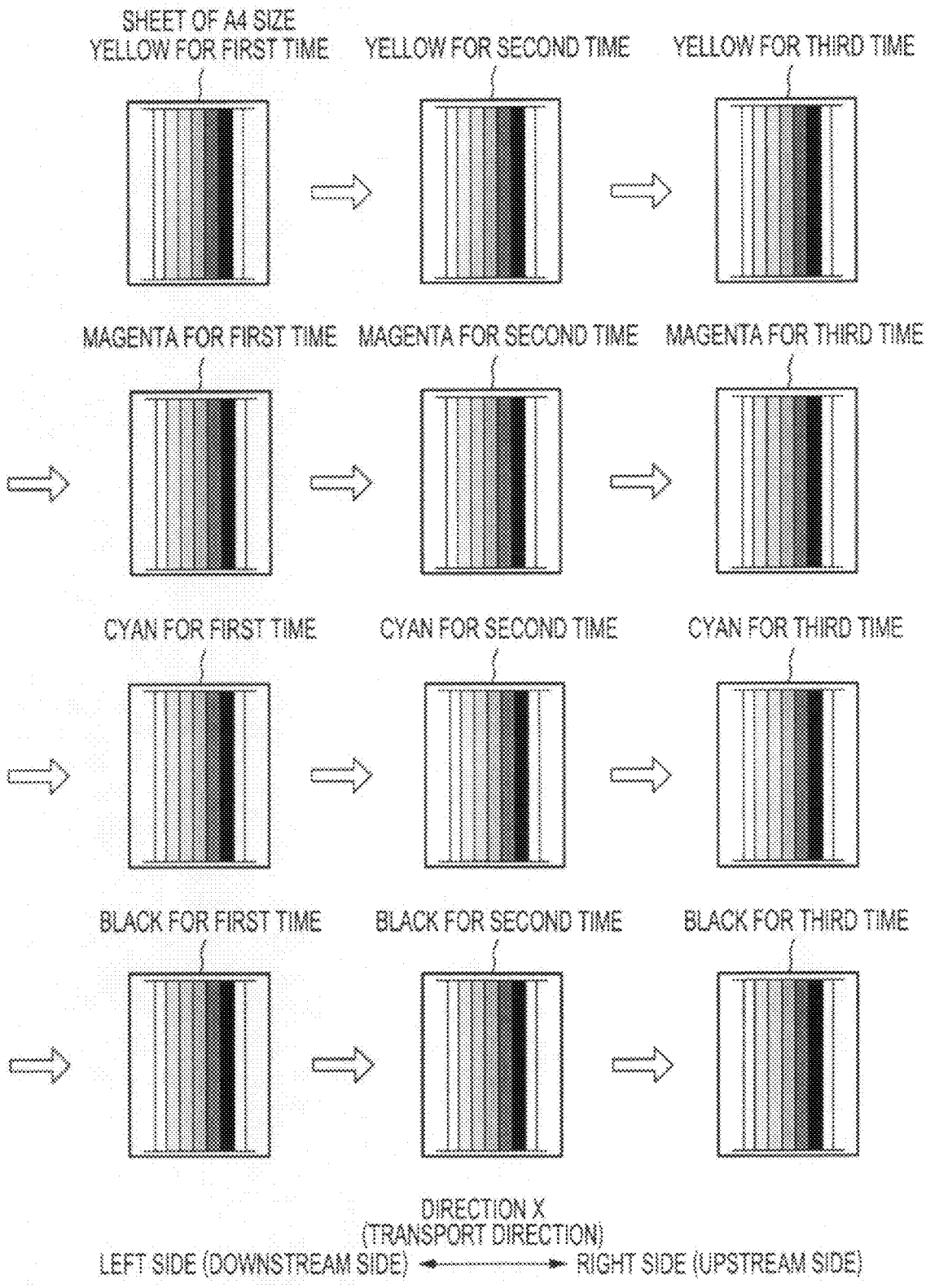
FIG. 7 is a diagram showing a printing example of a test pattern according to a comparative example.

FIG. 7 is a diagram showing a printing example of a test pattern according to a comparative example that is different from this embodiment. In the comparative example, in order to increase the accuracy of the correction value H to be calculated, each nozzle row YMCK prints test patterns three times on an A4-size sheet. As a result, three test patterns are formed for each of yellow, magenta, cyan, and black colors. In addition, on a sheet on which the test pattern of the comparative example is printed, differently from a sheet (FIG. 6B) on which the test pattern according to this embodiment is printed, the print information of the test pattern is not printed.

Thereafter, a tester performing a test process sets 12 printed test patterns in the scanner in the order denoted by arrows (in the order of yellow, magenta, cyan, and black colors) shown in the figure, so that 12 test patterns are individually read out by the scanner. The scanner transmits the read-out results (read-out data) of the test patterns to the computer 50 in the read-out order. The scanner detects the contrasting density of the test pattern based on the intensity of light. Here, the read-out result of the scanner is represented by a "read-out gray scale value". As the read-out gray scale value of an image becomes higher, the image is a "thick image (an image having low brightness)". On the other hand, as the read-out gray scale value of an image becomes lower, the image is a "thin image (an image having high brightness)".

When receiving a read-out gray scale value of each test pattern from the scanner, the computer 50 calculates a correction value H based on the read-out gray scale value in accordance with the correction value acquiring program. In the comparative example, only the test pattern is printed on the sheet, and thus, the read-out result that is transmitted from the scanner to the computer 50 is only the read-out gray scale value of the test pattern. Accordingly, the correction value acquiring program of the comparative example determines a read-out result that is read out by the scanner for the first time to be the "read-out gray scale value of the test pattern of the yellow color". In addition, the correction value acquiring program determines a read-out result that is read out by the scanner for the fourth time to be the "read-out gray scale value of the test pattern of the magenta color". In other words, the correction value acquiring program of the comparative example determines that a read-out gray scale value is the read-out gray scale value of a test pattern of a specific color (specific nozzle row) based on the order in which the test pattern is read out by the scanner (the order in which the scanner transmits the read-out gray scale values to the computer 50). In particular, the correction value acquiring program of the comparative example determines that the read-out results read out by the scanner for the first time to the third time are the "read-out gray scale values of the test pattern of the yellow color". In addition, the correction value acquiring program of the comparative example determines that that the read-out results read out by the scanner for the fourth time to the sixth time are determined to be the "read-out gray scale values of the test patterns of the magenta color". Accordingly, the tester should allow the scanner to read out the test patterns in the order that is set in the correction value acquiring program.

In addition, the correction value acquiring program of the comparative example determines a read-out gray scale value to be a read-out gray scale value of a band-shaped pattern of a lower density orderly from a side of the read-out data, from which test patterns are read out, corresponding to the downstream side (hereinafter, referred to as a left side in direction X) in the transport direction. In other words, the correction value acquiring program of the comparative example determines read-out gray scale values to be a read-out gray scale value of a band-shaped pattern of density 30%, a read-out gray scale value of a band-shaped pattern of density 40% from the above-described side. Accordingly, the tester should set a sheet on which the test patterns are printed such that a band-shaped pattern of a lower density is located on the left side in direction X in the read-out data. In other words, the tester should pay attention to the direction of the sheet to be set in the scanner, as well.

As described above, the correction value acquiring program of the comparative example determines a read-out gray scale value to be a read-out result of a test pattern that is formed in a specific nozzle row (YMCK) based on the order and direction in which the scanner reads out the test pattern. In addition, the correction value acquiring program of the comparative example determines a read-out gray scale value among the read-out gray scale values of the test patterns to be a read-out result of a band-shaped pattern of specific-density percentage (30% to 70%). Thereby, correction values H corresponding to each nozzle row, each band-shaped pattern, and each row area are calculated.

In addition, the correction value acquiring program adjusts data of the read-out gray scale values such that the number of pixel rows, in which pixels are aligned in a direction (hereinafter, referred to as direction Y) corresponding to the transport direction, and the number of raster lines (the number of row areas) that constitute the test pattern are the same in the read-out data acquired from the test pattern read out by the scanner. In other words, the pixel rows read out by the scanner and the row areas on a sheet on which the test pattern is printed are associated with each other for one-to-one correspondence. In addition, the pixel row associated with each row area is decomposed into pixel rows corresponding to the band-shaped patterns such as a pixel row corresponding to a band-shaped pattern of 30% density and a pixel row corresponding to a band-shaped pattern of 40% density, orderly from the left side in the direction X again.

Then, in a pixel row corresponding to a row area of a specific band-shaped pattern, an average value of the read-out gray scale values of pixels belonging to the pixel row is determined to be the read-out gray scale value of the row area of the band-shaped pattern.

In addition, in the comparative example, three test patterns are printed for each nozzle row YMCK. Accordingly, three read-out gray scale values are acquired for each one row area. Thus, an average value of three read-out gray scale values is set as the read-out gray scale value of the row area. For example, an average value of a read-out gray scale value of the first row area of the band-shaped pattern of 30% density of the first test pattern of the yellow color, a read-out gray scale value of the first row area of the band-shaped pattern of 30% density of the second test pattern of the yellow color, and a read-out gray scale value of the first row area of the band-shaped pattern of 30% density of the third test pattern of the yellow color is set as a "read-out gray scale value of the first row area of the band-shaped pattern of 30% density of the yellow color". As described above, when the read-out gray scale values corresponding to each nozzle row, each band-shaped pattern, and each row area are calculated, correction values H are calculated based on the read-out gray scale values.

As described above, by calculating the correction values H based on the average values of the read-out gray scale values of the test patterns that are printed and read out several times, the printing error of the test patterns and the read-out error of the scanner can be reduced. Therefore, more accurate correction values H can be calculated.

Figure 8:
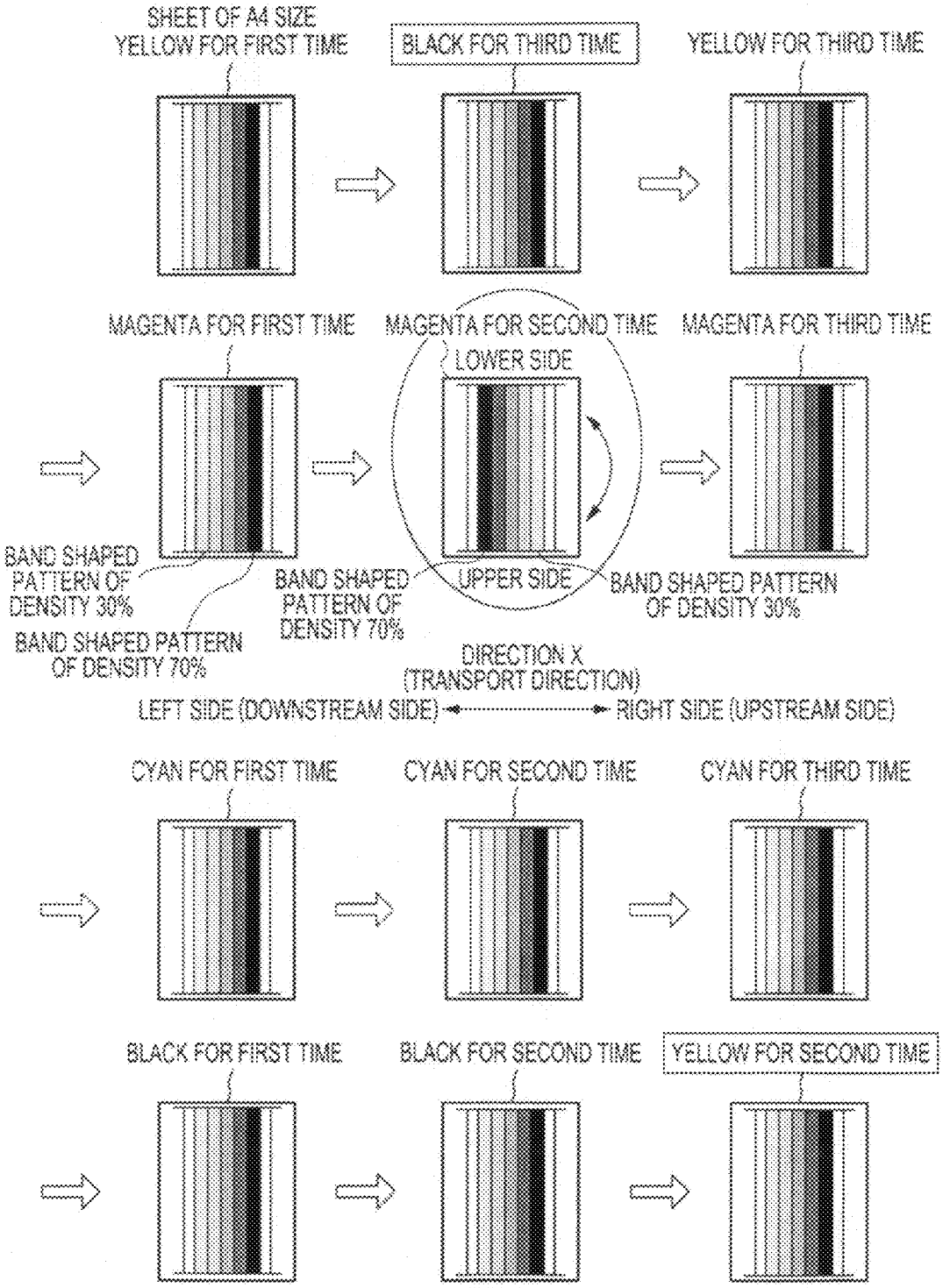
FIG. 8 is a diagram showing a case where the order and the direction in which a sheet is set in a scanner are incorrectly set.

FIG. 8 is a diagram for a case where the order in which the test patterns are read out by the scanner and the direction in which the test patterns are set in the scanner are incorrectly set. In the correction value acquiring program of the comparative example, in order to determine a read-out result to be a read-out result of a specific band-shaped pattern of a nozzle row based on the order and the direction in which the scanner reads out the test patterns, the tester should pay attention to the order in which the test patterns are read out by the scanner and the direction in which a sheet is set in the scanner. Accordingly, by printing many test patterns and allowing the scanner to read out many test patterns, the correction values H having higher accuracy can be calculated. On the other hand, by allowing the scanner to read out many test patterns, the operation of the tester becomes complicated. Therefore, mistakes in the operation may be caused easily.

For example, as shown in FIG. 8, it is assumed that the order in which the test pattern of the black color and the test pattern of the yellow color are read by the scanner is reversed mistakenly. In such a case, even when the scanner reads out a test pattern of the black color for the second time, the correction value acquiring program of this comparative example determines a read-out scale value that is read out by the scanner for the second time to be a "read-out gray scale value of a test pattern of the yellow color". Similarly, even when the scanner reads out a test pattern of the yellow color for the last time, a read-out gray scale value that is read out by the scanner for the last time is determined to be a "read-out gray scale value of a test pattern of the black color". As a result, a correction value H of the yellow color is calculated based on an average value of read-out gray scale values of two test patterns of the yellow color and a read-out gray scale value of one test pattern of the black color. In addition, a correction value H of the black color is calculated based on an average value of read-out gray scale values of two test patterns of the black color and a read-out gray scale value of one test pattern of the yellow color.

In other words, when the order in which the test patterns are read out by the scanner is incorrectly set, the correction value H is calculated based on the read-out gray scale values of test patterns that are formed by a different nozzle row. Accordingly, the non-uniformity of density cannot be corrected. In particular, when a test pattern of a light color such as the yellow color and a test pattern of a dark color such as the black color are replaced with each other in calculating the correction values H, the correction value H of the yellow color is corrected to be too light, and the correction value H of the black color is corrected to be too dark. As a result, the non-uniformity of density may be aggravated.

In addition, as a test pattern of the magenta color shown in FIG. 8, when a sheet on which the test patterns are printed may be set in the scanner in the vertically reversed direction mistakenly. In such a case, in the read-out data, a read-out gray scale value of a band-shaped pattern of 70% density is located on the right side in the direction X in the read-out result of a second test pattern of the magenta color, while a read-out gray scale value of a band-shaped pattern of 30% density is located on the left side in the direction X in the read-out results of other test patterns. Even when the read-out result of the band-shaped pattern of 70% density is located on the left side in the direction X in the read-out data, the correction value acquiring program of the comparative example determines the read-out result located on the left side in the direction X to be a "read-out gray scale value of a band-shaped pattern of 30% density". As a result, a correction value H of the band-shaped pattern of 30% density is calculated based on an average value of the read-out gray scale values of two band-shaped patterns of 30% density and a read-out gray scale value of one band-shaped pattern of 70% density. In addition, a correction value H of the band-shaped pattern of 70% density is calculated based on an average value of the read-out gray scale values of two band-shaped patterns of 70% density and a read-out gray scale value of one band-shaped pattern of 30% density.

In other words, when the direction for setting the sheet on which the test pattern is printed is incorrectly set, the correction value H is calculated based on the read-out gray scale value of a band-shaped pattern of a different density. Accordingly, the non-uniformity of density cannot be corrected. In particular, an image directed to be printed in a light density (for example, 30% density) is corrected to be too light, and an image directed to be printed in a dark density (for example, 70% density) is corrected to be too dark. Accordingly, the non-uniformity of density may be aggravated. In addition, when the sheet on which the test pattern is printed is set in the scanner in a vertical direction opposite to a correct setting direction of the scanner, the order of the row areas is reversed. As a result, for example, a correction value H of a row area corresponding to nozzle #180 is calculated based on a read-out gray scale value of a row area corresponding to nozzle #1, and thereby a correct correction value H cannot be calculated.

In addition, when the sheet on which the test pattern is printed is set in the scanner with being rotated by 90 degrees (or 270 degrees) with respect to the correct direction for setting the scanner mistakenly, a correction value H is calculated based on the read-out gray scale value of a band-shaped pattern of a different density. As a result, the non-uniformity of density cannot be corrected.

To sum up the descriptions above, in the comparative example, only the test pattern is printed on the sheet. Accordingly, the correction value acquiring program determines a read-out result to be a read-out result of a band-shaped pattern of a specific nozzle row based on the order in which the scanner reads out the test pattern and the direction in which the test pattern is read out by the scanner. Accordingly, when the order in which the sheets on which the test patterns are printed is incorrectly set or the direction in which the sheet is set is incorrectly set, a correct correction value H cannot be calculated. As a result, the non-uniformity of density cannot be suppressed.

In addition, in the comparative example, the order in which the sheet on which the test pattern is printed is set in the scanner and the direction for setting the sheet is important. Accordingly, the tester should set the test pattern in the scanner carefully, and thereby an operation time is lengthened.

According to some aspects of the invention, an accurate correction value H is calculated efficiently.

<Printing Test Pattern and Reading out Test Pattern According to First Embodiment>

Figure 9A:
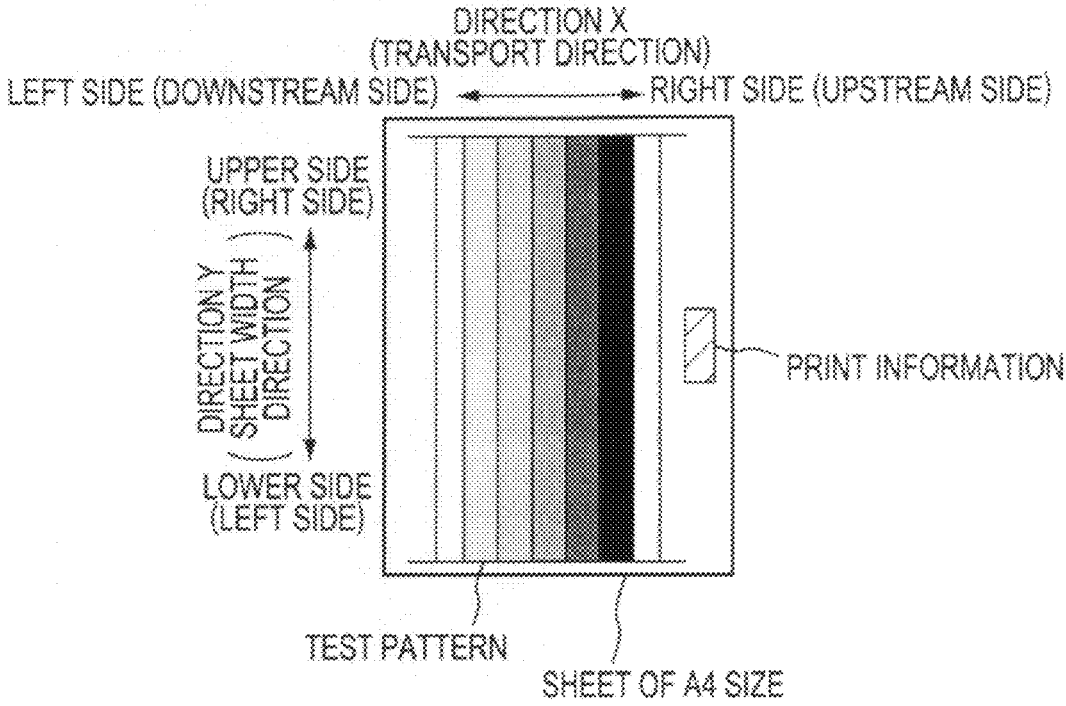
FIG. 9A is a diagram showing a test pattern according to a first embodiment of the invention.

FIG. 9A is a diagram showing a sheet on which a test pattern according to a first embodiment of the invention is printed. According to this embodiment, on each sheet on which a test pattern is printed, "print information" relating to the test pattern is printed together. The print information may be printed as characters, or the print information may be printed as a bar code. In addition, the form of the print information is not limited thereto. Thus, a seal on which the print information (characters or a bar code) is printed is attached to the sheet on which a test pattern is printed or a memory chip storing the print information may be buried in the sheet. In other words, the print information of a test pattern that is printed on a sheet is formed (included) on the sheet, so that a correction value acquiring program can match the read-out result of the test pattern and the print information of the test pattern.

Accordingly, when the sheet on which the print information and the test pattern are printed is read out by the scanner, the scanner reads out not only the density of the test pattern but also the print information, which is printed as characters or a bar code, as image data. Then, the correction value acquiring program (or the computer 50) receives the image data of the print information together with the read-out result of the test pattern that is acquired by the scanner. Then, the correction value acquiring program acquires information on the test pattern by identifying the image data (read-out data) of the print information. In addition, in this embodiment, similarly to the comparative example, in order to increase the accuracy of the correction value H, test patterns are printed on a plurality of (for example, three) sheets by each nozzle row YMCK.

As the "print information", "color information (information of a liquid type)" that is used for determining the nozzle row YMCK that forms the test pattern printed on the sheet is included. Accordingly, the correction value acquiring program can determine a read-out result of the test pattern that is read out together with the print information by the scanner to be a test pattern that is formed by a specific nozzle row YMCK. As a result, according to this embodiment, it can be prevented that a correction value H is calculated based on a read-out result of a test pattern that is formed by a different nozzle row by incorrectly setting the order in which the test patterns are read out by the scanner, as in the comparative example. In other words, according to this embodiment, an accurate correction value H can be calculated for each ink type (liquid type) based on the read-out gray scale values of test patterns that are formed by a correct nozzle row YMCK.

Figure 9B:
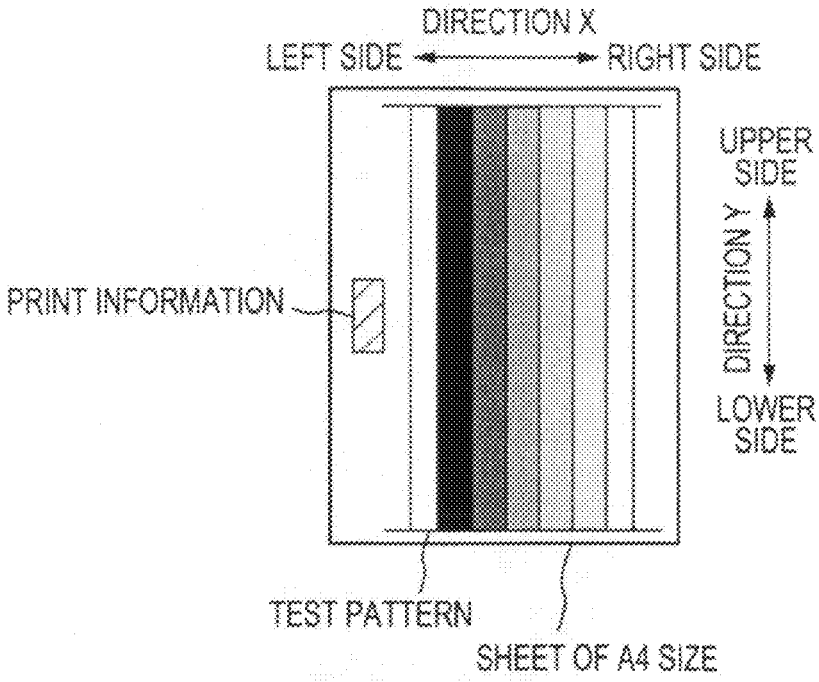
FIG. 9B is a diagram showing a read-out result for a case where a sheet is set in the scanner in a vertically reversed direction.

FIG. 9B is a diagram showing the read-out result for a case where the sheet is set in the scanner in a vertically reversed direction. As shown in FIG. 9A, for all the sheets on which the test patterns are printed, the "print information" is printed on the upstream side in the transport direction of the test pattern.

In such a case, on the read-out data acquired from reading the test pattern and the print information, the print information is located on the right side (a side corresponding to the upstream side in the transport direction) in the direction X relative to the test pattern. By printing the "print information" in a predetermined position with respect to the test pattern as described above, the correction value acquiring program can determine a case where the sheet is set in the vertically reversed direction based on the position of the print information with respect to the test pattern. For example, as shown in FIG. 9B, in a case where the print information is located on the left side in the direction X relative to the test pattern in the read-out data, the correction value acquiring program can determine that the sheet is set in the scanner in the vertically reversed direction. As described above, by setting the print information to be printed on one side in the transport direction (or on one side in the sheet width direction) relative to the test pattern, the direction of the test pattern can be determined based on the positional relationship of the print information and the test pattern in the read-out data that is read out by the scanner. For example, it may be configured that the correction value acquiring program determines that a read-out gray scale value of a band-shaped pattern that is closest to the print information is a read-out gray scale value of a band-shaped pattern of 70% density and determines that a read-out gray scale value of a band-shaped pattern that is farthest from the print information is a read-out gray scale value of a band-shaped pattern of 30% density in the read-out data. In such a case, the accurate correction value H can be calculated based on the read-out gray scale value of a band shaped pattern of a correct density. In addition, the correction value of the row area can be calculated based on the read-out result of the correct row area.

Similarly, even in a case where the sheet on which the test pattern is printed is mistakenly set in the scanner by being rotated by 90 degrees (or 270 degrees) from the correct direction for setting the scanner, the correction value acquiring program can determine the case based on the position of the print information relative to the test pattern. As a result, an accurate correction value H can be calculated based on the read-out gray scale value of a band-shaped pattern of a correct density.

As described above, according to this embodiment, on the sheet, not only a test pattern is printed, but also the print information (the color information and the liquid type) of the test pattern is printed together. Accordingly, it can be prevented that the correction value H is calculated based on a read-out gray scale value of a test pattern of a different nozzle row or a read-out gray scale value of a different band-shaped pattern. As a result, an accurate correction value H is calculated, and thereby the non-uniformity of density is suppressed.

In addition, in the line head printer as in this embodiment, as shown in FIG. 6B, the test pattern is printed by using all the nozzles aligned in the sheet width direction, any nozzle is not located on the right side or the left side in the sheet width direction relative to the test pattern. Accordingly, the print information cannot be printed on the right side or the left side in the sheet width direction relative to the test pattern. Thus, the print information is configured to be printed on the upstream side or the downstream side in the transport direction of the test pattern. In addition, even a test pattern of the yellow color may be printed by using a nozzle row of the black color for easy read-out of the print information.

In addition, by printing a test pattern and the print information of the test pattern on a sheet, unlike in the comparative example, a tester can set the sheet in the scanner without considering the order in which sheets, on which the test patterns are printed, are set in the scanner or the direction in which the sheet is set in the scanner. Accordingly, in this embodiment, the correction value H can be calculated more efficiently than the comparative example. In particular, for a case where the test patterns are printed on a plurality of sheets for calculating the correction value H having high accuracy, setting the sheets without considering the order in which the sheets are set in the scanner and the direction in which the sheet is set in the scanner becomes more effective. In addition, the correction value H may be newly calculated again not only in a manufacturing process of the printer but also based on the user. Even in such a case, by printing a test pattern and the print information of the test pattern on a sheet, the user needs not pay attention to the order in which the sheets are set in the scanner or the direction in which the sheet is set. Accordingly, even when a user who is not accustomed to the operation for calculating the correction value H, unlike a tester in the test process, performs the operation, a correction value H can be calculated accurately.

In addition, as the "print information", not only the color information YMCK but also "test pattern number information" may be included. For example, as the test pattern number information, printing three test patterns of each of the yellow, magenta, cyan, and black colors may be stored for the printer 1 according to this embodiment. In such a case, when the tester (user) forgets setting any test pattern in the scanner, the correction value acquiring program can recognize that the read-out result of the test pattern is not acquired based on the print information. Accordingly, the correction value acquiring program can notify the user that the test pattern is not read out by the scanner. Therefore, the user can have the test pattern, which is forgotten to be set in the scanner, to be read out by the scanner. In other words, when there is any test pattern that is printed by the printer 1 and is not read out by the scanner, the problem can be notified, and thereby all the test patterns printed by the printer 1 can be read out by the scanner assuredly. By allowing the scanner to read out all the test patterns, the correction value H can be calculated more accurately, and thereby waste of the test pattern that is printed by the printer 1 can be prevented. In addition, the correction value acquiring program is not limited to notification the tester of the test pattern that is not read out. Thus, the correction value acquiring program may be configured to direct the test pattern that has not been read by the scanner to be printed by the printer 1 again.

In a test process, one computer 50 may be configured to calculate correction values H of a plurality of types of printers. In addition, depending on the types of the printers 1, while there is a printer that prints a plurality of patterns for calculating the correction value H with high accuracy, there is a printer that prints a plurality of test patterns for a correction value H of dark ink such as ink of the black color K for increasing the accuracy and prints fewer test patterns for a correction value H of light ink such as ink of the yellow color Y of which accuracy needs not to be increased more than necessary. In other words, depending on the types of the printers, the numbers of printed test patterns may be different. Thus, by including the "test pattern number information" as the print information, the correction value acquiring program can check whether all the test patterns printed by each type of the printers are read out by the scanner.

In addition, since the printer 1 according to this embodiment prints three test patterns of each nozzle row, "page information of a test pattern" may be included as the print information. For example, it may be configured that a character "Y1" is printed on a sheet on which a first test pattern of the yellow color is printed, a character "Y2" is printed on a sheet on which a second test pattern of the yellow color is printed, and a character "Y3" is printed on a sheet on which a third test pattern of the yellow color is printed. Accordingly, for a case where the tester allows the first and second test patterns of the yellow color to be read by the scanner and forgets to allow the third test pattern of the yellow color to be read by the scanner, the correction value acquiring program can recognize that the third test pattern of the yellow color has not been read out by the scanner yet, and represent an error-message display of "Third Test Pattern 'Y3' of Yellow Color Has Not Been Read by Scanner" to the tester. In such a case, the tester can find a test pattern (sheet) on which "Y3" is written and allow the test pattern to be read by the scanner.

In addition, an "identification code (for example, a body number or a production number) of the printer 1" may be included as the "print information". In such a case, a correction value H that is calculated based on the read-out result of a test pattern can be stored in a memory 13 of the printer 1 that prints the test pattern. In a test process, test patterns are printed by many printers, and many test patterns are read out by the scanner. Accordingly, the same as in the comparative example, when any information other than the test pattern is not printed on a sheet, a correction value H that is calculated based on the read-out result of a test pattern may be stored in a memory 13 of a printer 1 other than the printer 1 that prints the test pattern. As a result, the non-uniformity of density cannot be corrected. Accordingly, same as in this embodiment, by printing a test pattern and an identification code of a printer that prints the test pattern on a sheet, the correction value H on the basis of the read-out result of the test pattern printed by a printer 1 can be stored in the memory 13 of the printer 1.

Furthermore, as the "print information", a "type of a medium (a plain sheet, a glossy sheet, or the like)" may be included. In a printer that can print a plurality of types of media and have different correction values H depending on the types of the media, the type of a medium on which a test pattern is printed is printed as the print information. In such a case, for example, it can be prevented that a correction value H that is calculated based on the read-out gray scale value of a test pattern printed on a plain sheet is mistakenly stored in a memory 13 of the printer 1 as a correction value H of a glossy sheet.

Until now, as the "print information", color information, sheet number information, and the like have been exemplified. However, all the information needs not to be stored as the "character" or the "bar code". For example, serial numbers may be assigned in the order of test patterns that are printed by the printer 1. In such a case, the print information of the test pattern corresponding to a serial number is stored in the computer 50 (correction value acquiring program). The correction value acquiring program acquires print information corresponding to the "serial number" that is read out together with a test pattern and associates the read-out gray scale value of the test pattern with the acquired print information. For example, a test pattern and a serial number "1" are printed on a first plain sheet by using a nozzle row of the yellow color. At this moment, the computer 50 (correction value acquiring program) stores the print information of a test pattern having the serial number of "1" as "yellow color, first sheet, plain sheet". Then, the correction value acquiring program associates the read-out gray scale value of the test pattern that is read out together with the serial number "1" with the print information of "yellow color, first sheet, plain sheet". Accordingly, an accurate correction value H can be calculated. As described above, a case where the serial number or the like is printed instead of printing all the print information can shorten a printing time of the printer and a read-out time of the scanner.

Figure 10:
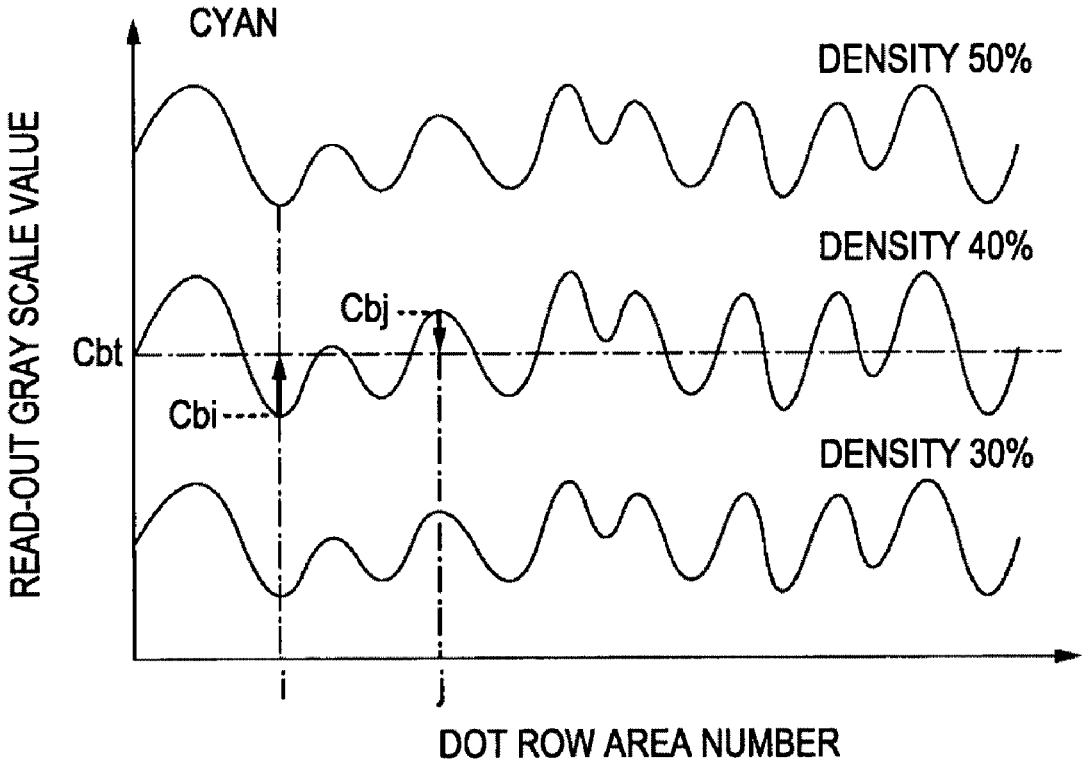
FIG. 10 is a diagram showing read-out gray scale values of band shaped patterns as graphs.

FIG. 10 is a diagram showing the read-out gray scale values of band shaped patterns of 30% to 50% densities of the cyan color as graphs. As described above, when the correction value acquiring program associates the read-out gray scale values of a plurality of test patterns that is formed in each nozzle row YMCK and the print information that is printed together with the test pattern, as described above in the comparative example, the read-out gray scale values for each nozzle row, each band-shaped pattern, and each row area are calculated. The graphs shown in the figure are examples of the calculated read-out gray scale values. In the graph, the horizontal axis represents a row area number, and the vertical axis denotes a read-out gray scale value corresponding to each row area. As shown in the graphs, although the band shaped patterns are formed uniformly in accordance with the directed gray scale values, there is a deviation of the read-out grey scale values for each row area. For example, in the graphs shown in FIG. 10, an i-th row area is recognized to be thinner than other row areas, and the j-th row area is recognized to be thicker than other row areas. The deviation of density for each row area causes the non-uniformity of density in a printed image. A method of calculating the correction value H for reducing the non-uniformity of density will be described as below.

<S004: Method of Calculating Correction Value H>

The correction values H are calculated based on the read-out gray scale values corresponding to the nozzle rows, the band shaped patterns, and the row areas. In order to decrease the density deviation as shown in FIG. 10, a density deviation for each row area at a same gray scale value is eliminated. In other words, by approaching the density of the row areas to a constant value, the non-uniformity of density is suppressed.

Thus, for a same directed gray scale value, for example, Sb, an average value Cbt of the read-out gray scale values for the whole row areas is set as a "target value Cbt". Then, the gray scale values of pixels corresponding to the row areas are corrected such that the read-out gray scale values for the directed gray scale value Sb approach the target value Cbt.

For an i-row area in which the read-out gray scale value Cbi for the directed gray scale value Sb is smaller than the target value Cbt, the gray scale value is corrected before a half-tone process and a density correcting process such that a printing operation is performed to be thicker than the setting of the directed gray scale value Sb. On the other hand, for a j-row area (Cbj) in which the read-out gray scale value is larger than the target value Cbt, the gray scale value is corrected such that a printing operation is performed to be thinner than the setting of the directed gray scale value Sb.

Figure 11A:
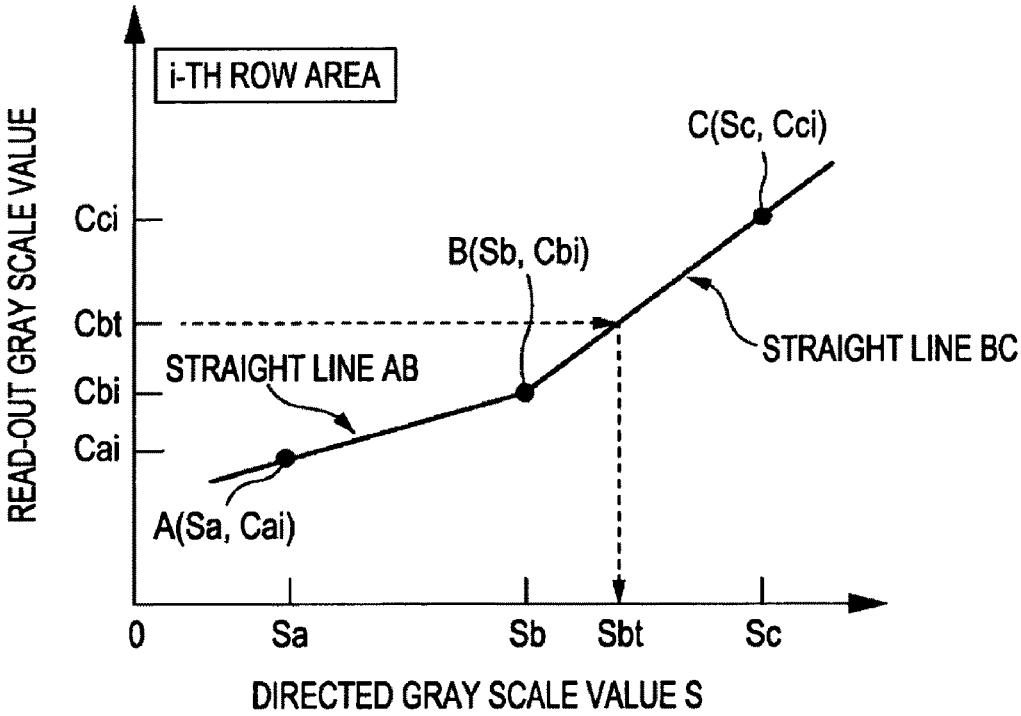
FIGS. 11A and 11B are diagrams showing a method of calculating a target gray scale value.

FIG. 11A is a diagram showing a method of calculating the target gray scale value Sbt for the i-th row area for which the read-out result is smaller than the target gray scale value Cbt. The horizontal axis represents a directed gray scale value, and the vertical axis represents a read-out gray scale value. On the graph, the read-out results (Cai, Cbi, and Cci) of the cyan color of the i-th row area for three directed gray scale values (Sa, Sb, and Sc) among five directed gray scale values are plotted. A target directed gray stale value Sbt for the i-th row area represented by the target value Cbt for the directed gray scale value Sb is calculated by using the following equation (linear interpolation on the basis of a straight line BC).

$$Sbt=Sb+(Sc-Sb)\times\{(Cbt-Cbi)/(Cci-Cbi)\}$$

Figure 11B:
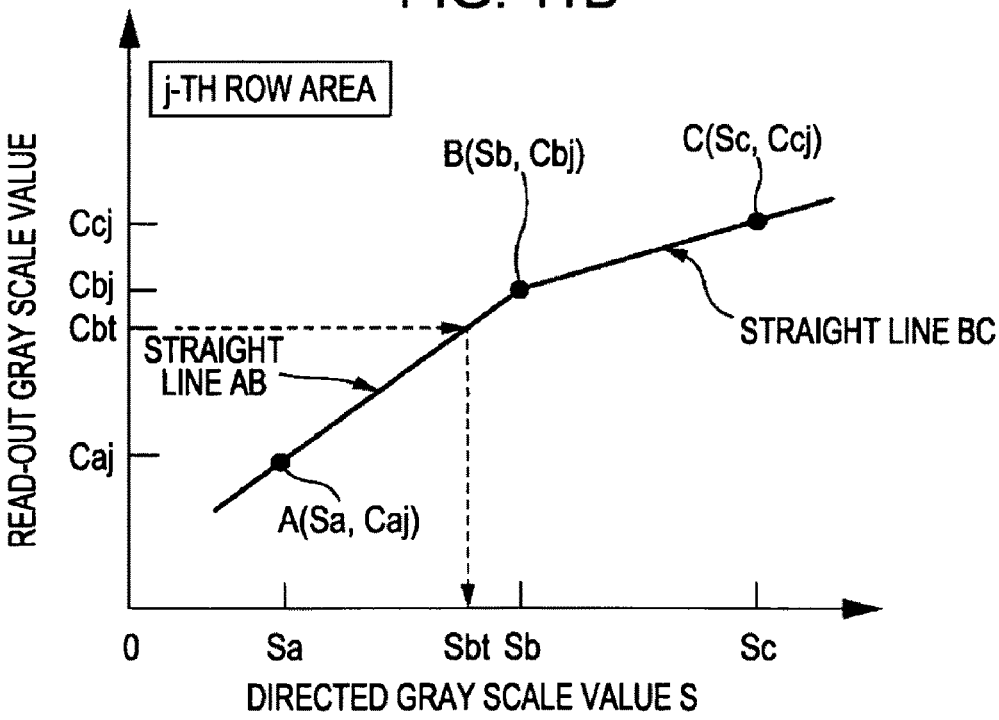

FIG. 11B is a diagram showing a method of calculating the target gray scale value Sbt for the j-th row area for which the read-out result is larger than the target gray scale value Cbt. On the graph, the read-out results of the cyan color of the j-th row area are plotted. A target directed gray scale value Sbt for the j-th row area represented by the target value Cbt for the directed gray scale value Sb is calculated by using the following equation (linear interpolation on the basis of a straight line AB).

$$Sbt=Sa+(Sb-Sa)\times\{(Cbt-Caj)/(Cbj-Caj)\}$$

As described above, after the target directed gray scale values Sbt for which density of each row area represented by the target value Cbt are calculated for the directed gray scale value Sb, the correction values H for the directed gray scale value Sb of each row area are calculated by using the following equation.

$$Hb=(Sbt-Sb)/Sb$$

Similarly, five correction values (Ha, Hb, Hc, Hd, and He) for five directed gray scale values (Sa, Sb, Sc, Sd, and Se) are calculated for each row area. In addition, the correction values H of nozzle rows other than cyan are also calculated.

<S005: Storage of Correction Value H>

FIG. 12 is a correction value table. After the correction values H are calculated, the correction values H are stored in a memory 13 of the printer 1. In the correction value table, five correction values (Ha_i, Hb_i, Hc_i, Hd_i, and He_i) for five directed gray scale values are assigned for each row area i. According to this embodiment, the correction values H are calculated for the number N (=180×n) of nozzles included in the printer 1. In addition, the correction value table is stored in the memory 13 for each nozzle row YMCK.

<Usage of User>

In the manufacturing process of the printer 1, after the correction values H for correcting non-uniformity of density are calculated to be stored in the memory 13 of the printer, the printer 1 is shipped. Then, when a user installs the printer driver for using the printer 1, the printer driver requests the printer 1 to transmit the correction values H, which are stored in the memory 13, to the computer 50. The printer driver stores the correction values H, which are transmitted from the printer 1, in a memory mounted inside the computer 50.

Then, when receiving a print command from the user, the printer driver converts image data output from an application program into resolution for being printed on a sheet S by performing a resolution converting process. Next, the printer driver converts RGB data into CMYK data that is represented by a CMYK color space corresponding to ink of the printer 1 by performing a color converting process.

Thereafter, a gray scale value of a high gray scale that represents the pixel data is corrected by using the correction value H. The printer driver corrects the gray scale values (hereinafter, referred to as a gray scale value before correction S_in) of each pixel data based on the correction value H of a row area corresponding to the pixel data (hereafter, referred to as a gray scale value after correction S_out).

When the gray scale value before correction S_in is the same as any one of directed gray scale values Sa, Sb, Sc, Sd, and Se, the correction values Ha, Hb, Hc, Hd, and He that are stored in the memory of the computer 50 can be directly used. For example, when the gray scale value before correction S_in=Sc, the gray scale value after correction S_out is acquired by using the following equation.

$$S_out=Sc\times(1+Hc)$$

Figure 13:
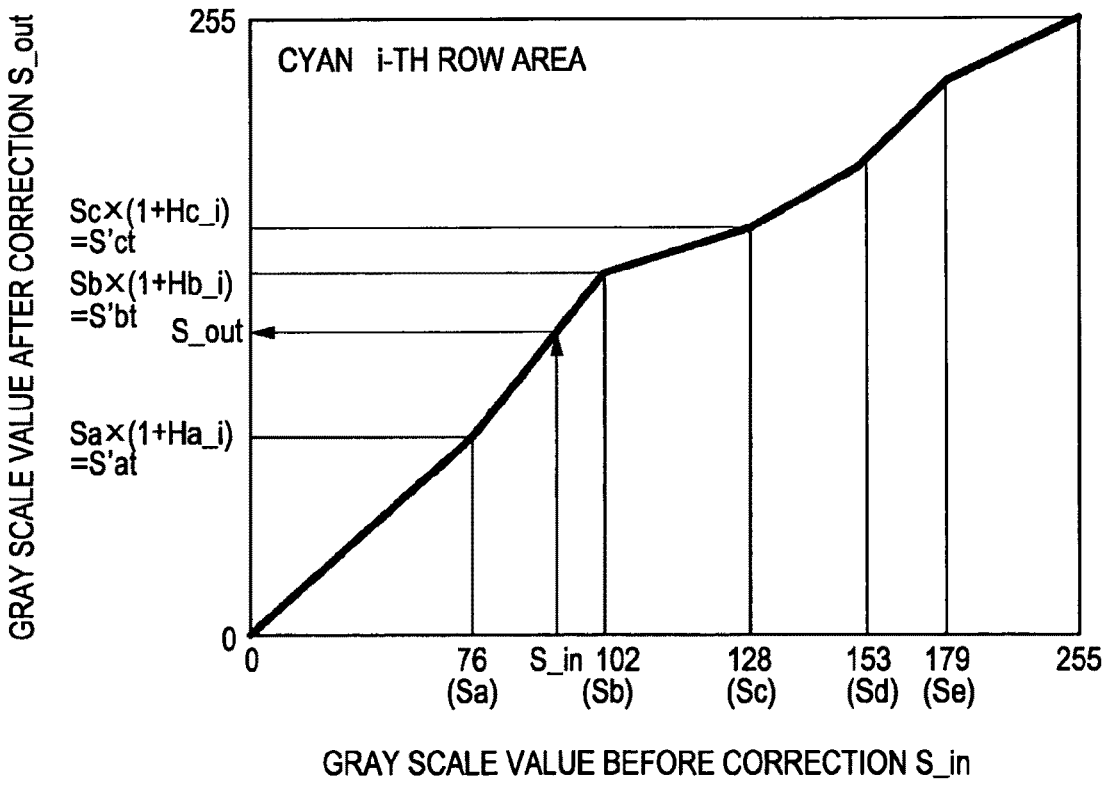
FIG. 13 is a diagram showing a method of correction where a gray scale value before correction is different from a directed gray scale value.

FIG. 13 is a diagram showing a correction method for a case where the gray scale value before correction S_in of i-th row area of cyan is different from the directed gray scale values. The horizontal axis represents a gray scale value before correction S_in, and the vertical axis represents a gray scale value after correction S_out. When the gray scale value before correction S_in is between the directed gray scale values Sa and Sb, the gray scale value after correction S_out is calculated based on a correction value Ha of the directed gray scale value Sa and a correction value Hb of the directed gray scale value Sb through linear interpolation by using the following equation.

$$S_out=Sa+(S'bt-S'at)\times\{(S_in-Sa)/(Sb-Sa)\}$$

In addition, when the gray scale value before correction S_in is smaller than the directed gray scale value Sa, the gray scale value after correction S_out is calculated by performing linear interpolation of the gray scale value of "0" (minimum gray scale value) and the directed gray scale value Sa. On the other hand, when the gray scale value before correction S_in is larger than the directed gray scale value Sc, the gray scale value after correction S_out is calculated by performing linear interpolation of the gray scale value of "255" (maximum gray scale value) and the directed gray scale value Sc. The correction method is not limited thereto, and it may be configured that a correction value H_out corresponding to the gray scale value before correction S_in other than the directed gray scale value is calculated, and the gray scale value after correction S_out is calculated (S_out=S_in×(1+H_out)).

After performing a density correcting process for each row area as described above, data of the high gray scale number is converted into data of a gray scale number that can be formed by the printer 1 by performing a half-tone process. Finally, by performing a rasterizing process, the image data in the form of a matrix can be arranged and switched in the order of data to be transmitted to the printer 1 for each pixel data. The print data generated through the above-described process is transmitted to the printer 1 together with command data (transport amount or the like) corresponding to the print mode by the printer driver. As a result, an image having reduced non-uniformity of density is printed.

Method of Calculating Correction Value H: Second Embodiment

Figure 14:
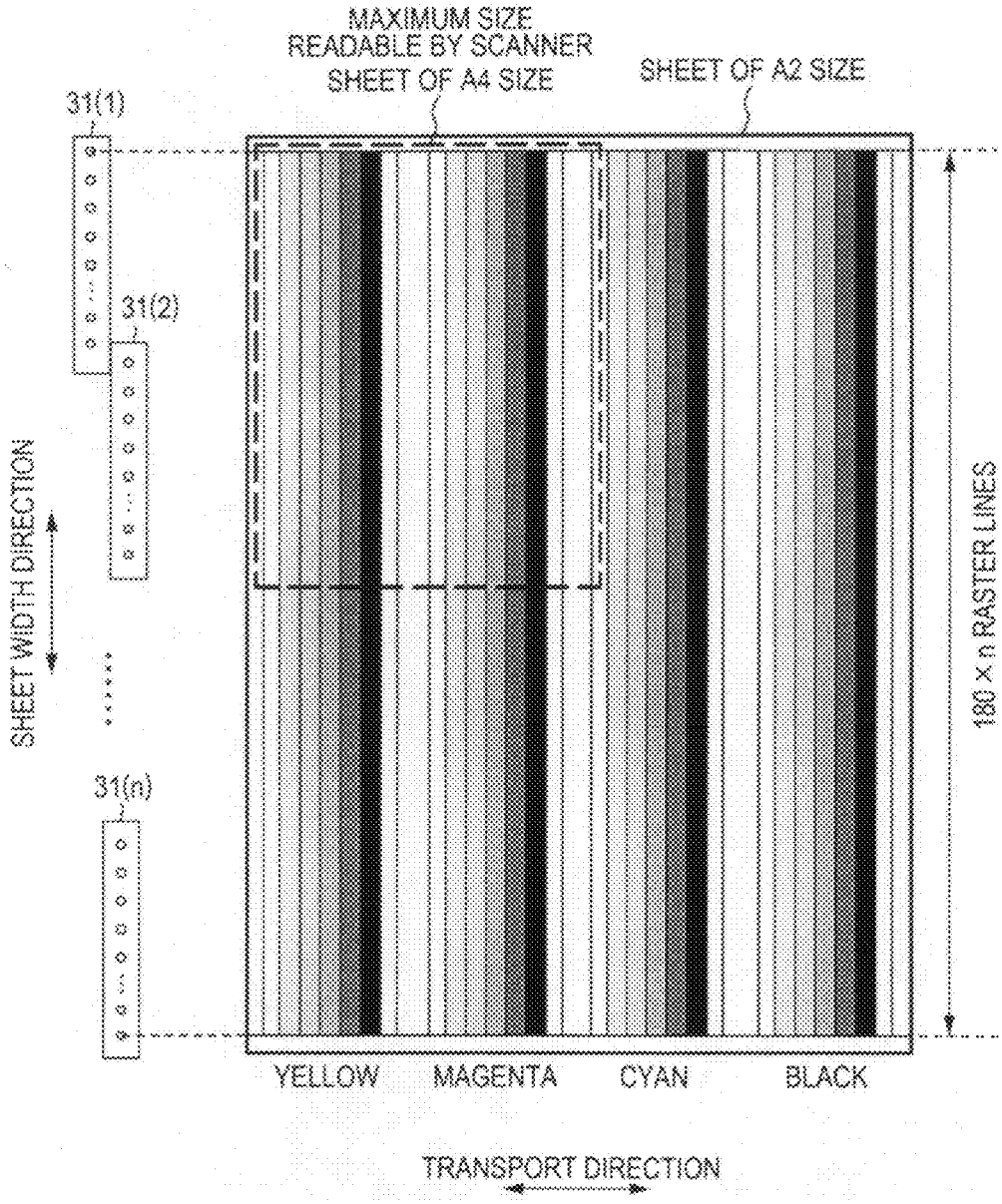
FIG. 14 is a diagram showing positional relationship between a test pattern and a head.

FIG. 14 is a diagram showing positional relationship between a test pattern printed by a printer 1 according to a second embodiment of the invention and a head 31. In the printer according to this second embodiment, it is assumed that a sheet of A2 size that is larger than that of the first embodiment can be printed. As the size of a sheet that is printable by the printer 1 is increased, the number of heads 31 (nozzles) aligned in the sheet width direction is increased, and thereby the length of a printed test pattern in the sheet width direction is lengthened. However, there is limit for the read-out range of the scanner. For example, for a case where the maximum read-out size of the scanner is A4 size (a dotted-line part in the figure), when the test pattern printed in a sheet of A2 size is set for the scanner, only a part of the test pattern can be read out.

Thus, for a case where a correction value H of the printer 1 that prints a sheet of a size (for example, a sheet of A2 size) larger than the readable range of the scanner is to be calculated, the test pattern is divided into several parts and printed on sheets (for example, sheets of A4 size) that can be read out by the scanner. Accordingly, the entire test pattern can be read out by the scanner.

Figure 15A:
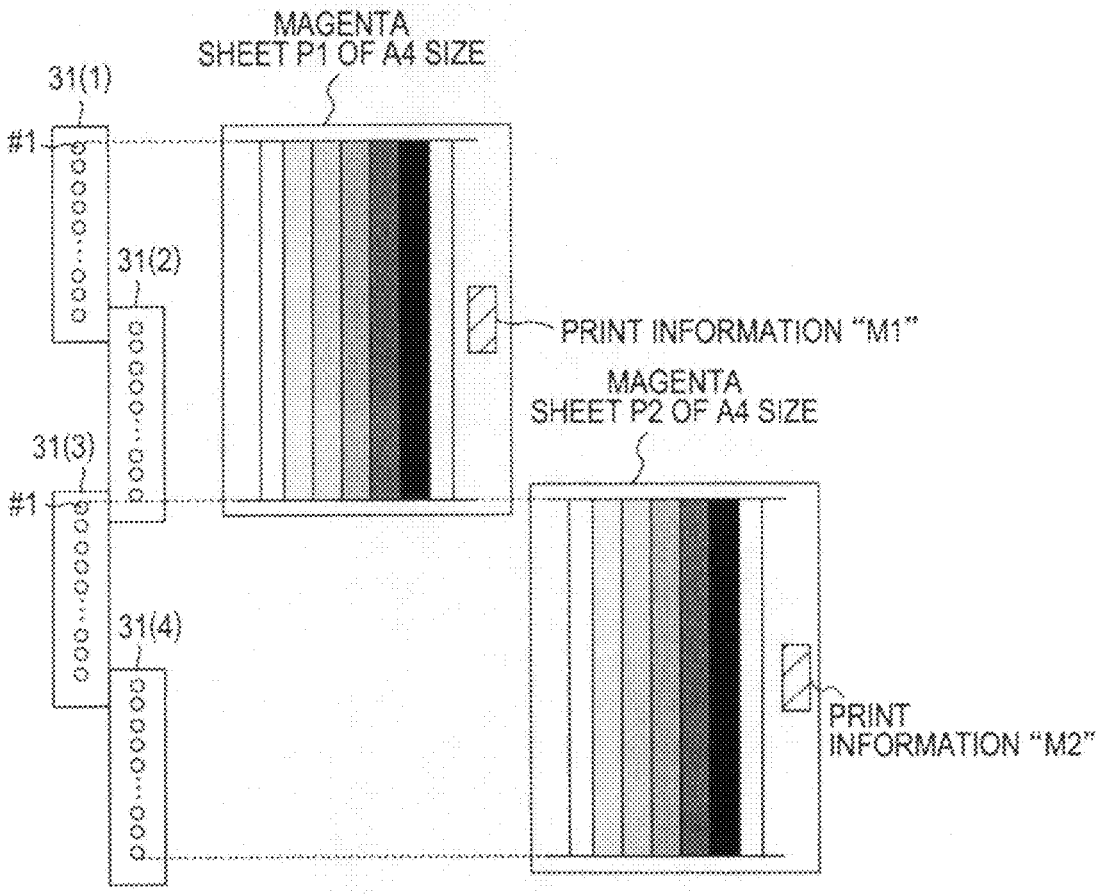
FIG. 15A is a diagram showing the appearance in which a large-size printer prints a test pattern.

FIG. 15A is a diagram showing sheets P1 and P2 on which test patterns are printed by a large-size printer according to the second embodiment. For the convenience of description, the number of the heads is decreased, and only a test pattern of a nozzle row of one color is exemplified. According to the printer 1 of the second embodiment, a test pattern is printed so as to exceed the read-out range of the scanner. Thus, the test pattern is divided so as to be printed on sheets of a size corresponding to a range of a size that can be read by the scanner. First, on one sheet P1 of A4 size, a test pattern and print information of the test pattern are printed by a first head 31(1) and a second head 31(2) (by using a first nozzle group). Then, on another sheet P2 of A4 size, a test pattern and print information of the test pattern are printed by a third head 31(3) and a fourth head 31(4) (by using a second nozzle group). Then, the first sheet P1 is set in the scanner, the test pattern printed on the sheet P1 is read out by the scanner, then, the sheet P1 is separated from the scanner, the second sheet P2 is set in the scanner, and the test pattern printed on the sheet P2 is read out by the scanner. As a result, all the test patterns that are formed by the printer 1 can be read out.

However, in the small-size printer shown in the first embodiment, the size of a test pattern that is formed by using all the heads 31 aligned in the sheet width direction is within the read-out range of the scanner. Accordingly, in order to increase the accuracy of the correction value H, all the plurality of test patterns that is printed by a nozzle row of a same color are formed by a same head 31. Therefore, print information for identifying a plurality of test patterns printed by a nozzle row of a same color is not needed.

On the contrary, for a large-size printer shown in the second embodiment, a test pattern printed on a sheet P1 and a test pattern printed on a sheet P2 are test patterns that are printed by a nozzle row of a same color. However, heads 31 (or nozzles) that print the test patterns are different. Accordingly, for a large-size printer that prints a sheet that exceeds the read-out range of the scanner, recognition of "a test pattern printed by a specific head 31 (or nozzle)" is needed as the print information.

When there is not any information of the head 31 that prints the test pattern, a read-out gray scale value of a test pattern printed on the sheet P2 by the third head 31(3) and the fourth head 31(4) may be mistakenly determined to be a read-out gray scale value of a test pattern printed by the first head 31(1) and the second head 31(2). In such a case, for example, a correction value H of a row area corresponding to nozzle #1 of the third head 31(3) is stored as a correction value H of a row area corresponding to nozzle #1 of the first head. By using the correction value H of a row area corresponding to a different nozzle, the non-uniformity of density cannot be reduced.

Thus, according to the second embodiment, on a sheet on which a test pattern is printed, information of the head 31 (or the nozzle) that prints the test pattern is printed as the "print information". For example, on a sheet P1 on which a test pattern of a magenta color is printed by the first head 31(1) and the second head 31(2), the type of the head 31 such as "M, a first head and a second head" is directly printed as the print information. In addition, the print information is not limited thereto. Thus, as shown in FIG. 15A, it may be configured that "M1" is printed on a sheet P1 on which a test pattern of the magenta color is printed by the first head 31(1) and the second head 31(2), and "M2" is printed on a sheet P2 on which a test pattern of the magenta color is printed by the third head 31(3) and the fourth head 31(4). In such a case, when recognizing "M1" based on the read-out result of the scanner, the correction value acquiring program can determine that the test pattern printed together with the print information "M1" is printed by the first head 31(1) and the second 31(2).

In other words, the scanner individually reads out the sheets P1 and P2 so as to acquire read-out data (the read-out results) thereof. Then, the print information (information) included in the read-out data is identified. When the print information represents that the test pattern is formed by the first head 31(1) and the second head 31(2), a correction value H of a row area corresponding to the first head 31(1) and the second head 31(2) is calculated based on the test pattern (the read-out gray scale value of the test pattern) that is included in the read-out data. On the other hand, when the print information represents that the test pattern is formed by the third head 31(3) and the fourth head 31(4), a correction value H of a row area corresponding to the third head 31(3) and the fourth head 31(4) is calculated based on the test pattern (the read-out gray scale value of the test pattern) that is included in the read-out data.

Accordingly, it can be prevented that a correction value H of a row area corresponding to a specific nozzle is calculated based on a read-out gray scale value of a test pattern that is formed in a nozzle other than the specific nozzle. Therefore, a correction value H can be accurately calculated based on the read-out gray scale value of the test pattern that is formed in the correct nozzle. As a result, the non-uniformity of density can be reduced.

In addition, in the first embodiment, as the "print information", color information, sheet number information, an identification code of a printer, medium information, and the like have been described as examples. However, on a sheet of the second embodiment, not only the information of the type of a head 31 that prints the test pattern but also the print information described in the first embodiment may be included as the print information. In addition, similarly to the first embodiment, in order to increase the accuracy of the correction value H, a plurality of test patterns may be configured to be printed by a same head 31. For example, three of each of sheets P1 and P2 of A4 size that are shown in FIG. 15A may be printed. When a plurality of test patterns is printed by the large-size printer 1, the number of the test patterns is larger than that of the first embodiment. Accordingly, for the large-size printer, particularly by printing a test pattern and the print information of the test pattern on a sheet, unlike the above-described comparative example, the tester does not need to pay attention to the order in which the sheets, on which the test patterns are printed, are set in the scanner or the direction of setting the sheet. Therefore, a correction value H can be calculated more efficiently.

Figure 15B:
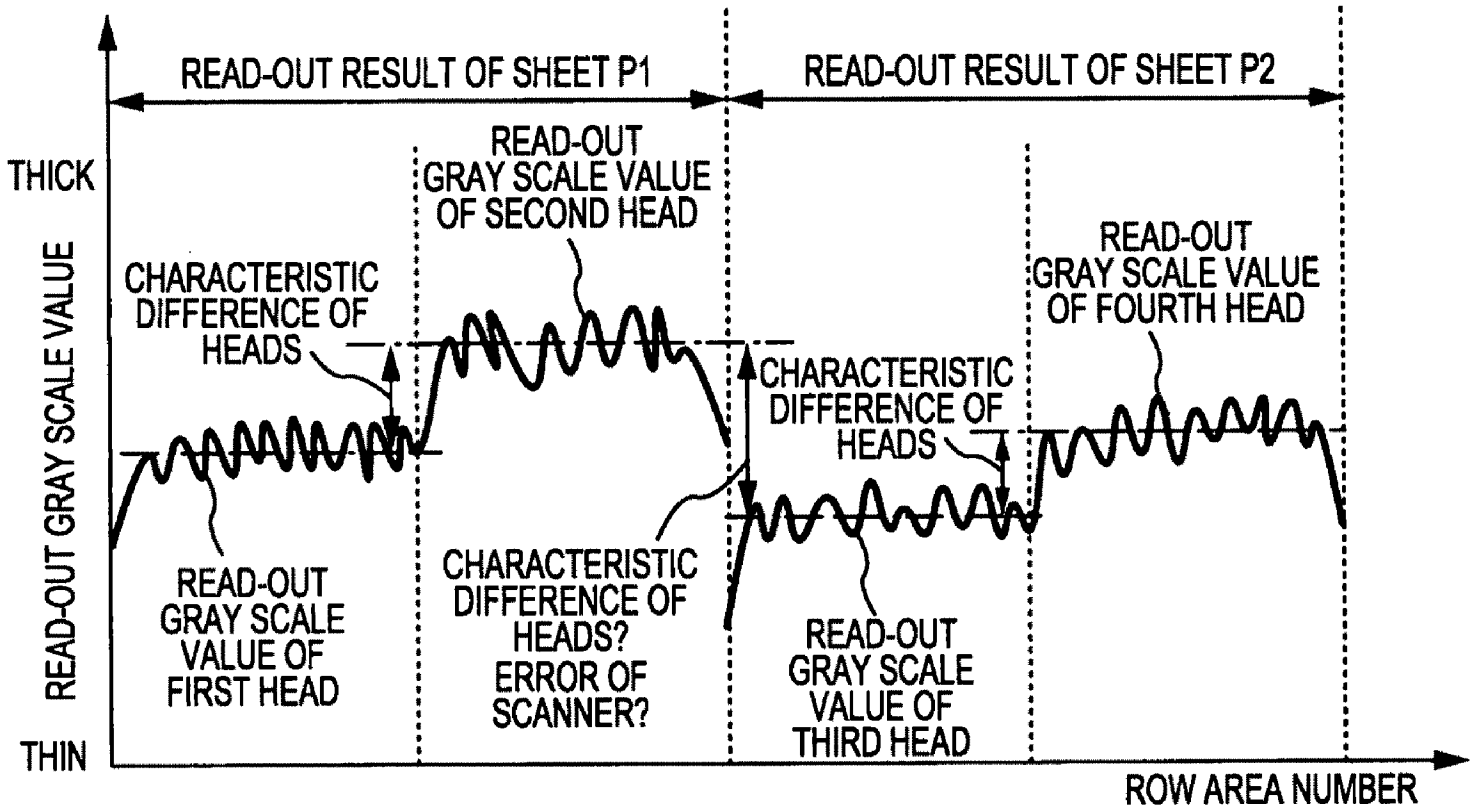
FIG. 15B is a diagram showing the read-out result thereof.

FIG. 15B is a diagram showing the read-out result of a band-shaped pattern of a directed gray scale value in the test pattern shown in FIG. 15A as a graph. In the graph, the horizontal direction represents a row area, and the vertical direction represents a read-out gray scale value of each row area. From the diagram showing the read-out result, it can be determined that a test pattern printed by the first head 31(1) and a test pattern printed by the second head 31(2) are printed on a same sheet P1 and are simultaneously read out by the scanner. Accordingly, a difference between a read-out gray scale value (a read-out gray scale value of the first head) of a test pattern that is formed by the first head 31(1) and a read-out gray scale value (a read-out gray scale value of the second head) of a test pattern that is formed by the second head 31(2) is a difference due to a characteristic difference of the head 31. Similarly, a difference between a read-out gray scale value (a read-out gray scale value of the third head) of a test pattern that is formed by the third head 31(3) and a read-out gray scale value (a read-out gray scale value of the fourth head) of a test pattern that is formed by the fourth head 31(4) is a difference due to a characteristic difference of the head 31. As described above, since the scanner may have an error in the read-out result due to the use condition or the like, there may be a read-out error of the scanner for a case where the sheet P1 is read out by the scanner and a case where the sheet P2 is read out by the scanner. Accordingly, a difference between the read-out gray scale value of the second head and a read-out gray scale value of the third head cannot be determined whether the difference is caused by a difference of the characteristics of the heads or the read-out error of the scanner.

When a correction value is calculated based on the read-out result (the read-out gray scale value) in which a read-out error of the scanner is included, non-uniformity of density cannot be suppressed. For example, in the read-out result shown in FIG. 15B, the read-out gray scale value of the second head is higher and thicker than the read-out scale value of the third head 31. Thus, a correction value H is calculated such that an image printed by the second head 31(2) is thin, and an image printed by the third head 31(3) is thick. Accordingly, when the difference between the read-out gray scale value of the second head and the read-out gray scale value of the third head is due to not the characteristic difference of heads but a read-out error of the scanner, the image printed by the second head 31(2) becomes too thin, and the image printed by the third head 31(3) becomes too thick. Therefore, the non-uniformity of density deteriorates. Accordingly, it is preferable that the test pattern is printed so as to decrease the read-out error of the scanner.

Figure 16A:
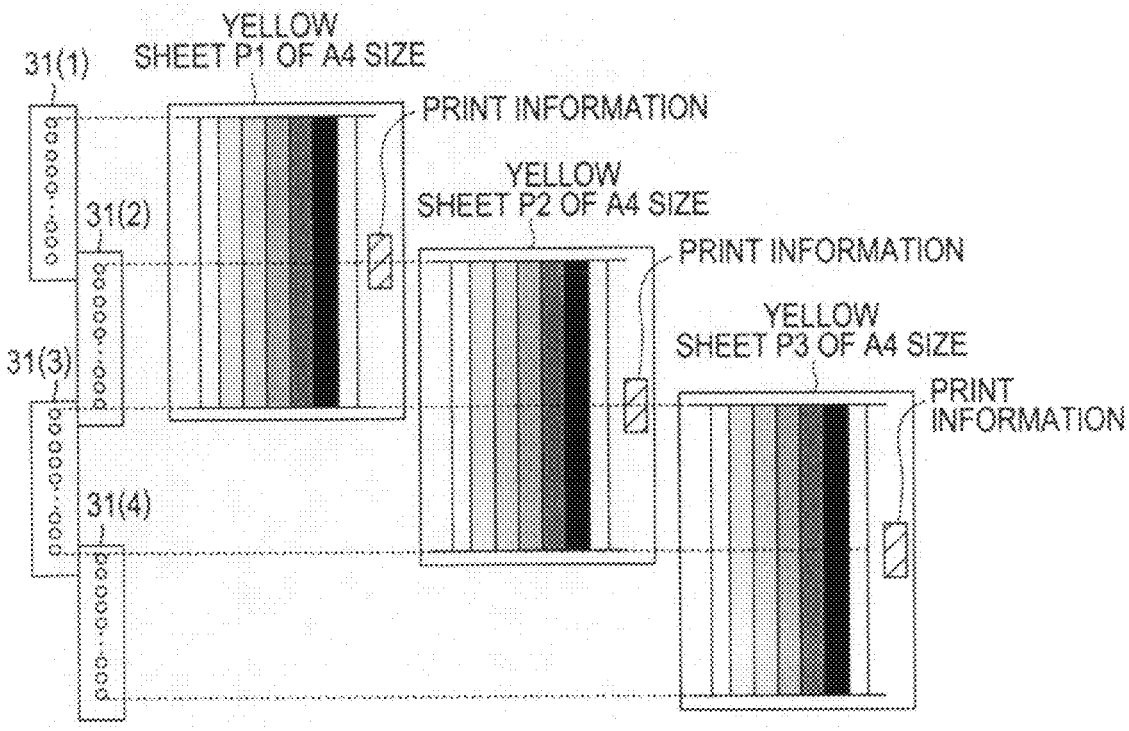
FIG. 16A is a diagram showing a printing example of a test pattern in which read-out error of the scanner can be decreased.
Figure 16B:
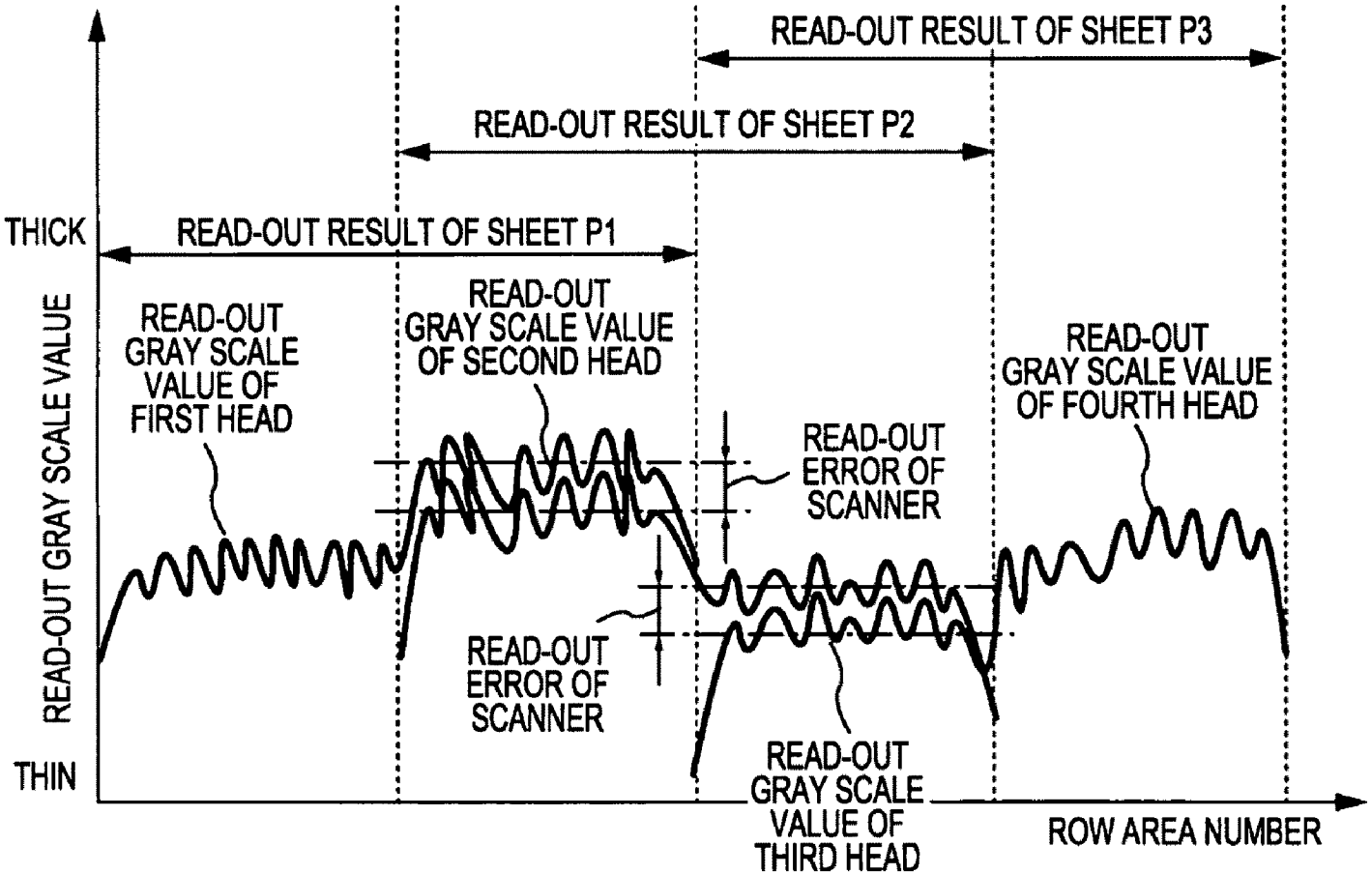
FIG. 16B is a diagram showing the read-out result thereof.

FIG. 16A is a diagram showing a printing example of a test pattern in which the read-out error of the scanner can be decreased. FIG. 16B is a diagram showing the read-out result of a band-shaped pattern of a specific directed gray scale value in the test patterns shown in FIG. 16A. A test pattern and print information of the test pattern are printed on a sheet P1 of A4 size by the first head 31(1) and the second head 31(2). In addition, a test pattern and print information of the test pattern are printed on a sheet P2 of A4 size by the second head 31(2) and the third head 31(3), and a test pattern and print information of the test pattern are printed on a sheet P3 of A4 size by the third head 31(3) and the fourth head 31(4).

That is, the second head 31(2) and the third head 31(3) print the test patterns on two sheets, respectively, and whereby two read-out gray scale values are acquired for one row area. As shown in FIG. 16B, although a same test pattern is printed by the second head 31(2), there is a difference between a read-out gray scale value of a test pattern printed on the sheet P1 by the second head 31(2) and a read-out gray scale value of a test pattern printed on the sheet P2 by the second head 31(2). This difference is a "read-out error of the scanner".

Accordingly, for example, the read-out results of the sheet P2 and the sheet P3 are corrected by the read-out error of the scanner with reference to the read-out result of the sheet P1. Then, a correction value H is calculated based on the read-out result from which the read-out error of the scanner is corrected. In this way, the correction value H can be calculated more accurately. As described above, when there is at least one head 31 (or a nozzle) that prints test patterns on a plurality of sheets that is not simultaneously read out by the scanner, the read-out error of the scanner can be calculated based on a difference between a read-out result of a test pattern printed on one sheet by the head and a read-out result of a test pattern printed on the other sheet by the head. In addition, the read-out error of the scanner in the read-out result of a test pattern that is not simultaneously read by the scanner can be corrected.

In addition, same as in the above-described first embodiment, the correction value H may be calculated based on an average value of read-out results of test patterns that are printed by the same head 31 and are not simultaneously read out by the scanner. In such a case, the read-out error of the scanner is decreased, and thereby a more accurate correction value H can be calculated.

MODIFIED EXAMPLES

Figure 17A:
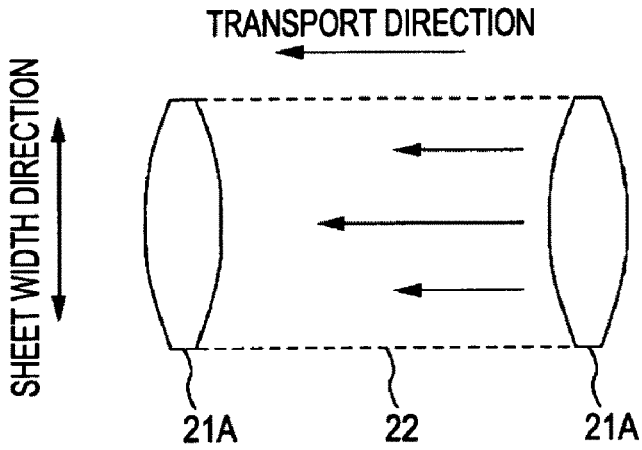
FIG. 17A is a top view of transport rollers.

FIG. 17A is a top view of transport rollers 21A and 21B. The printer 1 according to this embodiment, as shown in FIG. 2B, transports a sheet by using the transport belt 22 and the transport rollers 21A and 21B. In particular, the transport belt 22 of a printer that prints a large-sized sheet may be easily bent. Accordingly, as shown in FIG. 2A, the center portions of the transport rollers 21A and 21B are formed to be thick so as to apply tension to the transport belt 22. In such a case, a speed difference is generated between the center portion and the end portion in the sheet width direction on the transport belt 22. Thus, the center portion in the sheet width direction tends to have speed higher than that of the end portion. At this moment, when a sheet is not fed with the center portion of the transport belt 22 in the sheet width direction used as a reference, the sheet may be inclined during the transport process.

Figure 17B:
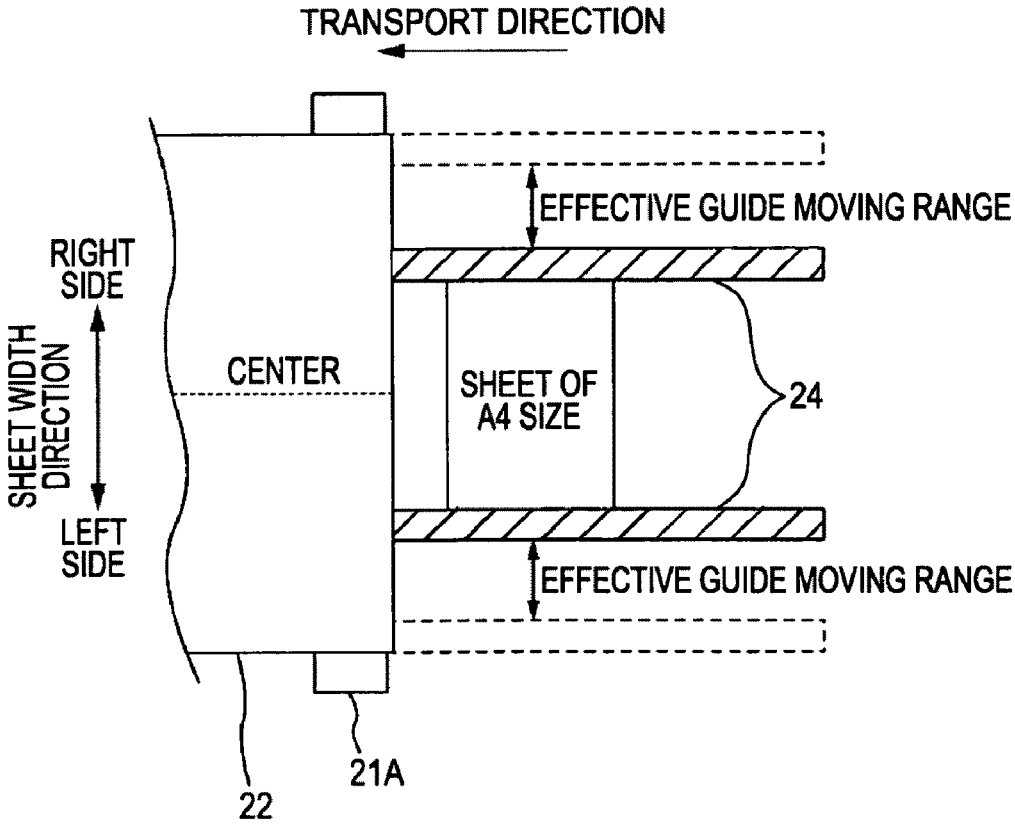
FIG. 17B is a diagram showing a transport guide.

FIG. 17B is a diagram showing transport guides 24 for transporting a sheet to a print area. A sheet is fed to the transport belt 22 along the transport guides 24 disposed on left and right sides in the sheet width direction, and whereby the sheet is fed without being inclined. When the transport guides 24 move with the center portion of the transport belt 22 in the sheet width direction used as the reference, a small-sized sheet (for example, a sheet of A4 size) cannot be moved and fed to the right end of the transport belt 22.

For a printer that prints a large-sized sheet (for example, a sheet of A2 size) that exceeds the read-out range of the scanner, a configuration in which a test pattern is divided and printed on small-size sheets (for example, a sheet of A4 size) is not limited. When a test pattern is printed on a small-sized sheet, for example, as shown in FIG. 15A, sheets P1 and P2 need to be positioned close to the right side or the left side of the transport belt 22. Accordingly, as shown in FIGS. 17A and 17B, in a printer in which a sheet should be fed with a center portion of the transport belt 22 used as a reference, a test pattern cannot be printed on a small-sized sheet by using heads 31 located on both ends in the sheet width direction.

Thus, according to this modified example, first, the test patterns are printed on a sheet of a size that can be printed by the printer, even when the size of the sheet exceeds the read-out range of the scanner. Thereafter, the sheet is cut into sheets of a size that can be read by the scanner. Accordingly, the test patterns printed by the printer as shown in FIGS. 17A and 17B can be read by the scanner. In other words, the test pattern printed on one sheet is cut into a plurality of sheets, and the plurality of sheets is individually read out by the scanner.

Figure 18:
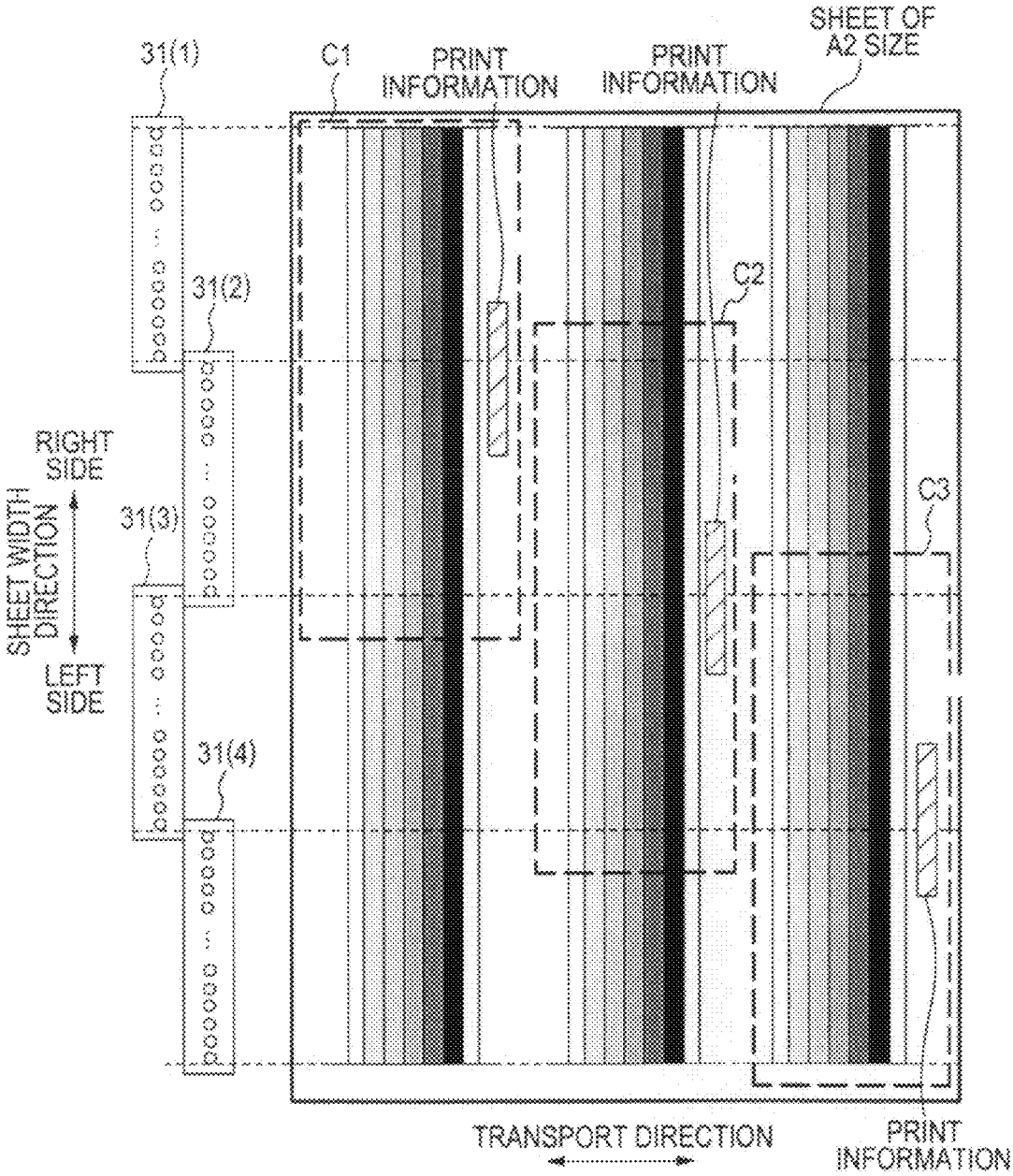
FIG. 18 is a diagram showing cutting positions of a test pattern printed on a sheet of A2 size.

FIG. 18 is a diagram showing the cutting positions of the test patterns printed on a sheet of A2 size by the printer 1. For the convenience of description, only test patterns that are formed on a yellow nozzle row are shown, and the number of heads is decreased. The print information is printed in spots by printing test patterns so as to fill out the sheet of A2 size in the sheet width direction by using all the heads 31(1) to 31(4). In order to acquire the read-out gray scale values of the test patterns printed by the first head 31(1) and the second head 31(2), the test pattern is cut in a cutting position C1 (dotted line) shown in FIG. 18. At this moment, within the range of the cutting position C1, print information including information of heads (the first head 31(1) and the second head 31(2)) that have printed the test patterns included in the cutting position C1 and the like are included. The test pattern needs to be cut so as to assuredly include a row area printed by the leftmost nozzle of the second head 31(2). Accordingly, a large range C1 is cut so as to include a test pattern that is formed by a nozzle located in the right end portion of the third head 31(3). By reading the cut sheet C'1 that is cut in the cutting position C1 by using the scanner, the read-out gray scale values of the test patterns that are formed by the first head 31(1) and the second head 31(2) can be acquired. In addition, in the cutting position C1, the test pattern that is formed by the nozzle located in the right end portion of the third head 31(3) is included. Accordingly, the influence of the margin (ground color) of the sheet on the read-out result of the test pattern that is formed by the nozzle located in the left end portion of the second head 31(2) can be prevented.

Next, in order to acquire the read-out gray scale values of the test patterns printed by the second head 31(2) and the third head 31(3), the test pattern is cut in a cutting position C2 from the sheet of A2 size. At this moment, within the range of the cutting position C2, print information including information of heads (the second head 31(2) and the third head 31(3)) that have printed the test patterns included in the cutting position C2 and the like are included. In addition, by cutting the sheet so as to include test patterns printed by a nozzle located in the left end portion of the first head 31(1) and a nozzle located in the right end portion of the fourth head 31(4), the influence of the margin (ground color) of the sheet on the read-out gray scale values of the second head and the read-out gray scale values of the third head can be prevented.

Similarly, in order to acquire the read-out gray scale values of the test patterns printed by the third head 31(3) and the fourth head 31(4), the test pattern is cut in a cutting position C3 from the sheet of A2 size. At this moment, within the range of the cutting position C3, print information including information of heads (the third head 31(3) and the fourth head 31(4)) that have printed the test patterns included in the cutting position C3 and the like are included.

Figure 19:
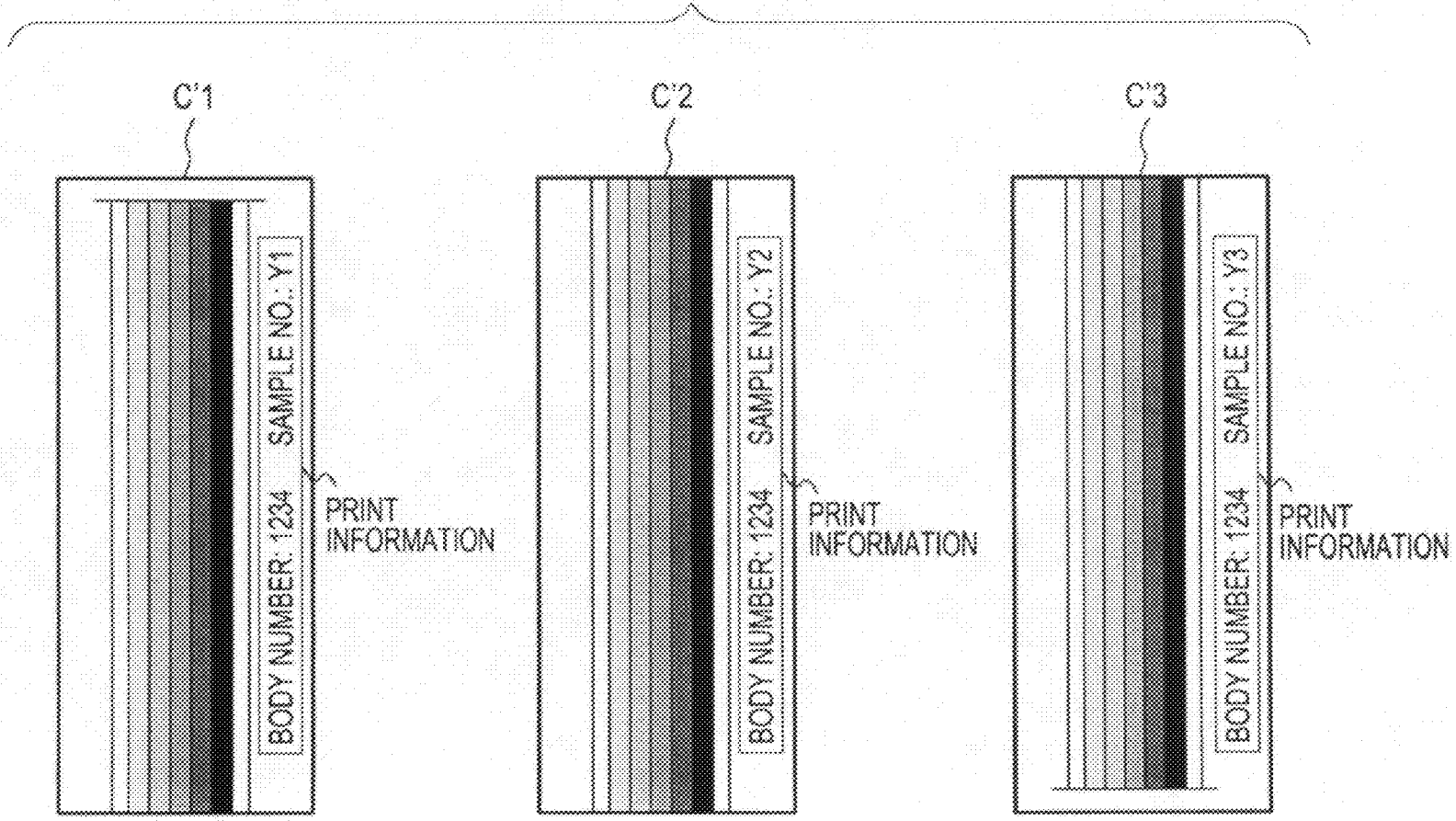
FIG. 19 is a diagram showing cut sheets that are cut from a sheet of A2 size.

FIG. 19 is a diagram showing the cut sheets C'1 to C'3 that are cut from a sheet of A2 size in the cutting positions C1 to C3. According to this embodiment, the print information representing a head and the color of a nozzle row that print a test pattern included in the cutting range is printed in accordance with the cutting positions. Then, a sheet on which the test pattern and the print information are printed is read out by the scanner. As shown in FIG. 19, in each cut sheet C'1 to C'3, a body number "1234", of a printer 1 that prints the test pattern, the color "Y (yellow)" of the nozzle row that prints the test pattern, and a serial number "1 to 3" that is used for identifying each cut sheet C'1 to C'3 are printed as the print information. In addition, the computer 50 (correction value acquiring program) stores the type of a head 31 that forms a test pattern as the print information corresponding to the serial number "1 to 3". Accordingly, the correction value acquiring program can determine that the test pattern printed on the cut sheet C'1 is a test pattern that is printed by the first head 31(1) and the second head 31(2) based on the print information (sample No) "Y1" that is printed on the cut sheet C'1. In addition, the correction value acquiring program can determine that the test pattern printed on the cut sheet C'2 is a test pattern that is printed by the second head 31(2) and the third head 31(3) based on the print information "Y2" that is printed on the cut sheet C'2 and can determine that the test pattern printed on the cut sheet C'3 is a test pattern that is printed by the third head 31(3) and the fourth head 31(4) based on the print information "Y3" that is printed on the cut sheet C'3.

As described above, the print information is configured to be included within the cutting range. Thus, when the cutting sheets after cutting are separated from one another and the original position of each cutting sheet in the sheet of A2 size is unknown, a head and a nozzle row that print each cut sheet can be determined. As a result, a correction value H is calculated based on the read-out gray scale value of the test pattern formed by a correct nozzle, and thereby the non-uniformity of density can be suppressed.

In addition, the test pattern printed by the second head 31(2) is included in both the cutting position C1 and the cutting position C2. As a result, a difference between a read-out gray scale value of a test pattern printed on the cut sheet C'1 by the second head 31(2) as the read-out gray scale value of the second head and a read-out gray scale value of a test pattern printed on the cut sheet C'2 by the second head 31(2) that is cut in the cutting position C2 can be calculated as a read-out error of the scanner for a case where the cut sheet C'1 is read out by the scanner and for a case where the cut sheet C'2 is read out by the scanner. Similarly, by having the test pattern printed by the third head 31(3) be included in both the cutting position C2 and the cutting position C3, the read-out error of the scanner for a case where the cut sheet C'2 is read out by the scanner and a case where the cut sheet C'3 cut in the cutting position C3 is read out by the scanner can be calculated. Then, a more accurate correction value H can be calculated by correcting the read-out gray scale value such that the read-out error of the scanner is eliminated based on the read-out error of the scanner. In addition, although the test pattern is printed so as to fill out the sheet of A2 size in the sheet width direction in FIG. 18, a test pattern and the print information of the test pattern may be configured to be printed in the range of the cutting positions C1 to C3.

Other Embodiments

In the above-described embodiment, a printing system having an ink jet printer has been mainly described. However, disclosure of a method of suppressing the non-uniformity of density and the like is included therein. The above-described embodiments are for easy understanding of the invention and are not for the purpose of limiting the invention. It is apparent that the invention may be changed or modified without departing from the gist of the invention, and equivalents thereof belong to the scope of the invention. In particular, embodiments described below also belong to the scope of the invention.

<Liquid Ejecting Apparatus>

In the above-described embodiments, as a liquid ejecting apparatus (a part) that performs a method of ejecting liquid, an ink jet printer has been described as an example. However, the invention is not limited thereto. The liquid ejecting apparatus may be applied to various industrial apparatuses other than a printer (printing device). For example, the invention may be applied to a coloring device for attaching shapes to a cloth, a display manufacturing apparatus such as a color filter manufacturing apparatus or an organic EL display, a DNA chip manufacturing apparatus that manufactures a DNA chip by coating the DNA chip with a solution into which DNA is melt, a circuit board manufacturing apparatus, and the like.

In addition, a liquid ejecting type may be a piezo type in which liquid is ejected by applying a voltage to a driving element (piezo element) so as to expand or contract an ink chamber or a thermal type in which air bubbles are generated inside a nozzle by using a heating element and liquid is ejected by using the air bubbles.

<Printer>

In the above-described embodiments, a line head printer is exemplified in which nozzles are aligned in the sheet width direction intersecting the transport direction of a medium.

However, the invention is not limited thereto. For example, a printer in which a dot forming operation for forming a dot row along the moving direction and a transport operation (moving operation) for transporting a sheet in the transport direction that is the nozzle row direction are alternately repeated while a head unit is moved in the moving direction intersecting the nozzle row direction may be used. When the above-described printer prints a plurality of test patterns or prints a test pattern that is larger than the read-out range of the scanner, an accurate correction value H can be calculated by printing the print information of a test pattern on a sheet on which the test pattern is printed.

What is claimed is:

1. A method of calculating a correction value, the method comprising:

forming a test pattern in which a dot row formed by aligning dots in a direction intersecting a predetermined direction is aligned in the predetermined direction on a medium and forming information on the test pattern on the medium, by using a first nozzle group of a liquid ejecting apparatus that includes a nozzle row, in which a plurality of nozzles ejecting liquid is aligned in the predetermined direction, having the first nozzle group and a second nozzle group;

forming a test pattern in which a dot row formed by aligning dots in the intersecting direction is aligned in the predetermined direction on a medium and forming information on the test pattern on the medium, by using the second nozzle group of the liquid ejecting apparatus;

acquiring two read-out data values by individually reading out the two media by using a scanner; and identifying the information included in the read-out data values, calculating a correction value of the first nozzle group based on the test pattern included in the read-out data values in a case where the information included in the read-out data values represents that the test pattern is formed by the first nozzle group, and calculating a correction value of the second nozzle group based on the test pattern included in the read-out data values in a case where the information included in the read-out data values represents that the test pattern is formed by the second nozzle group.

2. The method according to claim 1, wherein the information is formed on one side of the test pattern on the medium in the predetermined direction or the intersecting direction in the forming of the test pattern and the information, and wherein the direction of the test pattern is determined based on positional relationship of the information included in the read-out data values and the test pattern in the identifying of the information and calculating of the correction value.

3. The method according to claim 1, wherein the liquid ejecting apparatus includes a plurality of the nozzle rows, and the plurality of the nozzle rows ejects different types of liquid, and wherein the read-out data values are identified based on the type of the liquid represented by the information included in the read-out data values, and the correction value is calculated for each type of the liquid, in the identifying of the information and calculating of the correction value.

4. The method according to claim 1, wherein a case where there is the test pattern that is formed on the medium based on the information included in the read-out data by the liquid ejecting apparatus and is not read out by the scanner is notified in the identifying of the information and calculating of the correction value.

5. A program for calculating a correction value, the program allows a computer to perform:

a function for forming a test pattern in which a dot row formed by aligning dots in a direction intersecting a predetermined direction is aligned in the predetermined direction on a medium and forming information on the test pattern on the medium, by using a first nozzle group of a liquid ejecting apparatus that includes a nozzle row, in which a plurality of nozzles ejecting liquid is aligned in the predetermined direction, having the first nozzle group and a second nozzle group;

a function for forming a test pattern in which a dot row formed by aligning dots in the intersecting direction is aligned in the predetermined direction on a medium and forming information on the test pattern on the medium, by using the second nozzle group of the liquid ejecting apparatus;

a function for acquiring two read-out data values by individually reading the two media by using a scanner; and a function for identifying the information included in the read-out data values, calculating a correction value of the first nozzle group based on the test pattern included in the read-out data values in a case where the information included in the read-out data values represents that the test pattern is formed by the first nozzle group, and calculating a correction value of the second nozzle group based on the test pattern included in the read-out data values in a case where the information included in the read-out data values represents that the test pattern is formed by the second nozzle group.

6. A liquid ejecting apparatus in which a nozzle row, which is formed by aligning a plurality of nozzles ejecting liquid in a predetermined direction, is configured by a first nozzle group and a second nozzle group, the liquid ejecting apparatus comprising:

a unit that forms a test pattern in which a dot row formed by aligning dots in a direction intersecting the predetermined direction is aligned in the predetermined direction on a medium and information on the test pattern on the medium by using the first nozzle group; and a unit that forms a test pattern in which a dot row formed by aligning dots in the intersecting direction is aligned in the predetermined direction on a medium and information on the test pattern on the medium, by using the second nozzle group;

wherein a scanner individually reads out the two media and identifies the information included in the read-out data values from two acquired read-out data values, and wherein an image is corrected so as to be printed based on a correction value of the first nozzle group that is calculated based on the test pattern included in the read-out data values for a case where the information included in the read-out data values represents that the test pattern is-formed by the first nozzle group and a correction value of the second nozzle group that is calculated based on the test pattern included in the read-out data values for a case where the information included in the read-out data values represents that the test pattern is formed by the second nozzle group.

* * * * *